US012349776B2

(12) United States Patent
Krulik et al.

(10) Patent No.: US 12,349,776 B2
(45) Date of Patent: Jul. 8, 2025

(54) COMPRESSION AND EXPANSION DEVICE FOR LUGGAGE

(71) Applicant: United States Luggage, Hauppauge, NY (US)

(72) Inventors: Richard Krulik, Northport, NY (US); Adam Courter, Long Beach, NY (US); Hayley Lawson, Long Beach, NY (US); Jon Davies, Riverhead, NY (US)

(73) Assignee: United States Luggage, Hauppauge, NY (US)

( * ) Notice: Subject to any disclaimer, the term of this patent is extended or adjusted under 35 U.S.C. 154(b) by 80 days.

(21) Appl. No.: 18/221,616

(22) Filed: Jul. 13, 2023

(65) Prior Publication Data

US 2024/0016271 A1 Jan. 18, 2024

Related U.S. Application Data

(60) Provisional application No. 63/468,901, filed on May 25, 2023, provisional application No. 63/389,602, filed on Jul. 15, 2022.

(51) Int. Cl.
*A45C 7/00* (2006.01)
*A45C 5/03* (2006.01)

(52) U.S. Cl.
CPC ..... *A45C 7/0022* (2013.01); *A45C 5/03* (2013.01); *A45C 7/0063* (2013.01)

(58) Field of Classification Search
CPC ..... A45C 7/0022; A45C 5/03; A45C 7/0063
USPC ..... 190/103
See application file for complete search history.

(56) References Cited

U.S. PATENT DOCUMENTS 1,052,018 A * 2/1913 Spitz ..... A45C 7/0031 190/104
2,079,476 A * 5/1937 Wolff ..... A45C 3/00 190/105
5,671,831 A * 9/1997 Chiu ..... A45C 7/0031 333/2
6,220,411 B1 * 4/2001 Scicluna ..... A45C 7/0031 190/103

(Continued)

FOREIGN PATENT DOCUMENTS

TW M335178 U 7/2008

OTHER PUBLICATIONS

International Search Report dated Oct. 12, 2023 received in a corresponding foreign application, namely International Patent Application No. PCT/US 23/27701, 11 pages.

*Primary Examiner* — Nathan J Jenness
*Assistant Examiner* — Justin Caudill
(74) *Attorney, Agent, or Firm* — Scully, Scott, Murphy & Presser, P.C.

(57) ABSTRACT

A compression expansion device for an article of luggage and luggage comprising same is disclosed. In one particular practice: the device comprises a base section disposed in sliding relation with an expansion body engaged with each other by coil springs. A flexible portion on either the base section or expansion body comprises a ridge which rests on a complimentary ledge on the other of the base section or expansion body to assume a compressed configuration. A glide switch comprising one or more push projections contacts the flexible portion to displace the ridge off the ledge causing the base and expansion body to move away from each other and assume an expanded configuration.

60 Claims, 24 Drawing Sheets

(56) References Cited

U.S. PATENT DOCUMENTS

| | | | | |
|---|---|---|---|---|
| 6,390,259 | B1 * | 5/2002 | Lu | A45C 7/0022 190/103 |
| 6,408,997 | B1 * | 6/2002 | Chen | A45C 5/14 190/103 |
| 7,281,616 | B2 * | 10/2007 | Peterson | A45C 7/0031 220/8 |
| 7,328,779 | B2 * | 2/2008 | King | A45C 7/0022 190/104 |
| 2005/0067244 | A1 * | 3/2005 | Smith | A45C 7/0022 190/103 |
| 2006/0070837 | A1 * | 4/2006 | King | A45C 7/0022 190/105 |
| 2009/0166138 | A1 * | 7/2009 | Gorga | A45C 13/04 190/103 |
| 2013/0140119 | A1 * | 6/2013 | Hogan | A45C 7/0031 190/103 |
| 2017/0332755 | A1 | 11/2017 | Chiang | |
| 2022/0167718 | A1 * | 6/2022 | Krulik | A45C 13/10 |

* cited by examiner

COMPRESSION AND EXPANSION DEVICE FOR LUGGAGE

This application claims priority to U.S. Provisional Patent Application Ser. No. 63/389,602 filed Jul. 15, 2022, the entire contents of which are incorporated herein by reference, and claims priority to U.S. Provisional Patent Application Ser. No. 63/468,901 filed May 25, 2023, the entire contents of which are incorporated herein by reference.

FIELD

The disclosure relates to a compression and expansion device useful in luggage to increase or decrease the luggage internal capacity as needed. The disclosure also relates to luggage comprising such a device.

BACKGROUND

Expandable luggage as known in the art includes various designs to permit the compression and expansion of the luggage to accommodate internal volume needs. Such devices often require the person packing the luggage to use two hands or require multiple steps to manipulate the device, or have complicated designs that effect the luggage itself. There is a need for a locking compression and expansion device of simpler construction that can expand the luggage or compress it, including a desirable design that permits operation of the device by the slide of a switch to automatically expand the luggage, including practices where the switch is located on the outside of the article of luggage for convenient operation by the user.

SUMMARY

In one practice, the disclosure is directed to a compression expansion device for an article of luggage comprising a base section and an expansion body, the base section and expansion body disposed in sliding relation to each other and engaged with at least one bias member urging the base section and expansion body away from each other in an expanded configuration, wherein: (I) the base section comprises a flexible portion, the flexible portion comprising a protuberance facing the expansion body, the expansion body comprising a holding surface complimentary to the protuberance and on which the protuberance rests in a first position wherein the base section and the expansion body are in a compressed configuration; and an activation member, e.g. a glide switch, disposed opposite from and moveable across the protuberance, the activation member (e.g. glide switch) comprising a push projection configured to: (i) sufficiently contact the flexible portion to urge the protuberance to rest on the holding surface in the first position whereby the base section and expansion body are in the compressed configuration when the activation member (e.g. glide switch) is moved to a locked position, and (ii) sufficiently disengage from the flexible portion to displace the protuberance from the holding surface to a second position when the activation member (e.g. glide switch) is moved to a release position whereby the base section and expansion body assume the expanded configuration; or (II) the expansion body comprises a flexible portion, the flexible portion comprising a protuberance and a release protrusion both facing the base section, the release protrusion axially spaced from and extending outwardly beyond the protuberance, the base section comprising a holding surface complimentary to the protuberance and on which the protuberance rests in a first position wherein the base section and the expansion body are in a compressed configuration; and an activation member, e.g. a glide switch, disposed opposite from and movable across the release projection, the activation member (e.g. glide switch) comprising a push projection configured to sufficiently contact the release protrusion to displace the protuberance from the holding surface to a second position when the activation member (e.g. glide switch) is moved to a release position whereby the base section and expansion body assume the expanded configuration.

In a first embodiment, the disclosure is directed to a compression and expansion device for an article of luggage which comprises (a) a base section comprising a front face, a rear face, a top end, and a bottom end; a pair of spaced apart, parallel passageways axially disposed on the base section; and a flexible portion interposed between the pair of spaced apart parallel passageways and comprising a protuberance extending outwardly from the rear face; (b) an expansion body comprising an inner face, an outer face, an upper end, and a lower end; a pair of spaced apart parallel conduit members axially disposed on the expansion body, each of the pair of spaced apart parallel conduit members individually mated in a slidable manner with a respective spaced apart parallel passageway of the base section, the inner face of the expansion body disposed opposite the rear face of the base section; and a holding surface interposed between the pair of spaced apart parallel conduit members on the inner face of the expansion body and upon which the protuberance rests in a first position wherein the base section and the expansion body are in a compressed configuration; (c) a pair of biasing members, each individually disposed within a respective passageway and its respective conduit member, and each individually urging the expansion body away from the base section to an expanded configuration; and (d) a glide switch disposed opposite from and moveable across the protuberance, the glide switch comprising a push projection configured to: (i) sufficiently contact the flexible portion to urge the protuberance to rest on the holding surface in the first position whereby the base section and expansion body are in the compressed configuration when the glide switch is moved to a locked position, and (ii) sufficiently disengage from the flexible portion to displace the protuberance from the holding surface to a second position when the glide switch is moved to a release position whereby the base section and expanded portion assume the expanded configuration.

In a second embodiment, the disclosure is directed to a compression and expansion device for an article of luggage which comprises (a) a base section comprising a front face, a rear face, a top end, and a bottom end, a pair of spaced apart, parallel passageways axially disposed on the base section; and a holding surface disposed between the pair of spaced apart, parallel passageways; (b) an expansion body comprising an inner face, an outer face, an upper end, and a lower end; a pair of spaced apart parallel conduit members axially disposed on the expansion body, each of the pair of spaced apart parallel conduit members individually mated in a slidable manner with a respective spaced apart parallel passageway of the base section, the inner face of the expansion body disposed opposite the rear face of the base section; and a flexible portion disposed between the pair of spaced apart parallel conduit members, the flexible portion comprising a protuberance and a release protrusion both extending outwardly from the inner face of the expansion body, the release protrusion axially spaced from the protuberance; (c) a pair of biasing members, each individually disposed within a respective passageway and its respective conduit member, and each individually urging the expansion body away from the base section to an expanded configuration; and (d) a glide switch disposed opposite from and movable across the release projection, the glide switch comprising a push projection configured to sufficiently contact the release protrusion to displace the protuberance from the holding surface to a second position when the glide switch is moved to a release position whereby the base section and expanded portion assume the expanded configuration.

In one practice, the disclosure is directed to an article of luggage comprising a main luggage body having a bottom surface and a cavity formed to receive articles for packing; an expansion portion having a perimeter defining a cavity; a foldable gusset joining the luggage main body to the expansion portion; and at least one compression and expansion device disposed on a wall of the article of luggage, the compression and expansion device comprising: a base section affixed to one of the main luggage body or the expansion portion, and an expansion body affixed to the other of the main luggage body or expansion portion, the base section and the expansion body disposed in sliding relation to each other and engaged with at least one bias member urging the base section and expansion body away from each other in an expanded configuration, wherein: (I) the base section comprises a flexible portion, the flexible portion comprising a protuberance facing the expansion body, the expansion body comprising a holding surface complimentary to the protuberance and on which the protuberance rests in a first position wherein the base section and the expansion body are in a compressed configuration; and a glide switch disposed opposite from and moveable across the protuberance, the glide switch comprising a push projection configured to: (i) sufficiently contact the flexible portion to urge the protuberance to rest on the holding surface in the first position whereby the base section and expansion body are in the compressed configuration when the glide switch is moved to a locked position, and (ii) sufficiently disengage from the flexible portion to displace the protuberance from the holding surface to a second position when the glide switch is moved to a release position whereby the base section and expanded portion assume the expanded configuration; or (II) the expansion body comprises a flexible portion, the flexible portion comprising a protuberance and a release protrusion both facing the base section, the release protrusion axially spaced from and extending outwardly beyond the protuberance, the base section comprising a holding surface complimentary to the protuberance and on which the protuberance rests in a first position wherein the base section and the expansion body are in a compressed configuration; and a glide switch disposed opposite from and movable across the release projection, the glide switch comprising a push projection configured to sufficiently contact the release protrusion to displace the protuberance from the holding surface to a second position when the glide switch is moved to a release position whereby the base section and expanded portion assume the expanded configuration.

In another practice, the disclosure is directed to an article of luggage comprising the first embodiment of the compression and expansion device.

In another practice, the disclosure is directed to an article of luggage comprising the second embodiment of the compression and expansion device.

DETAILED DESCRIPTION

Figure 1:
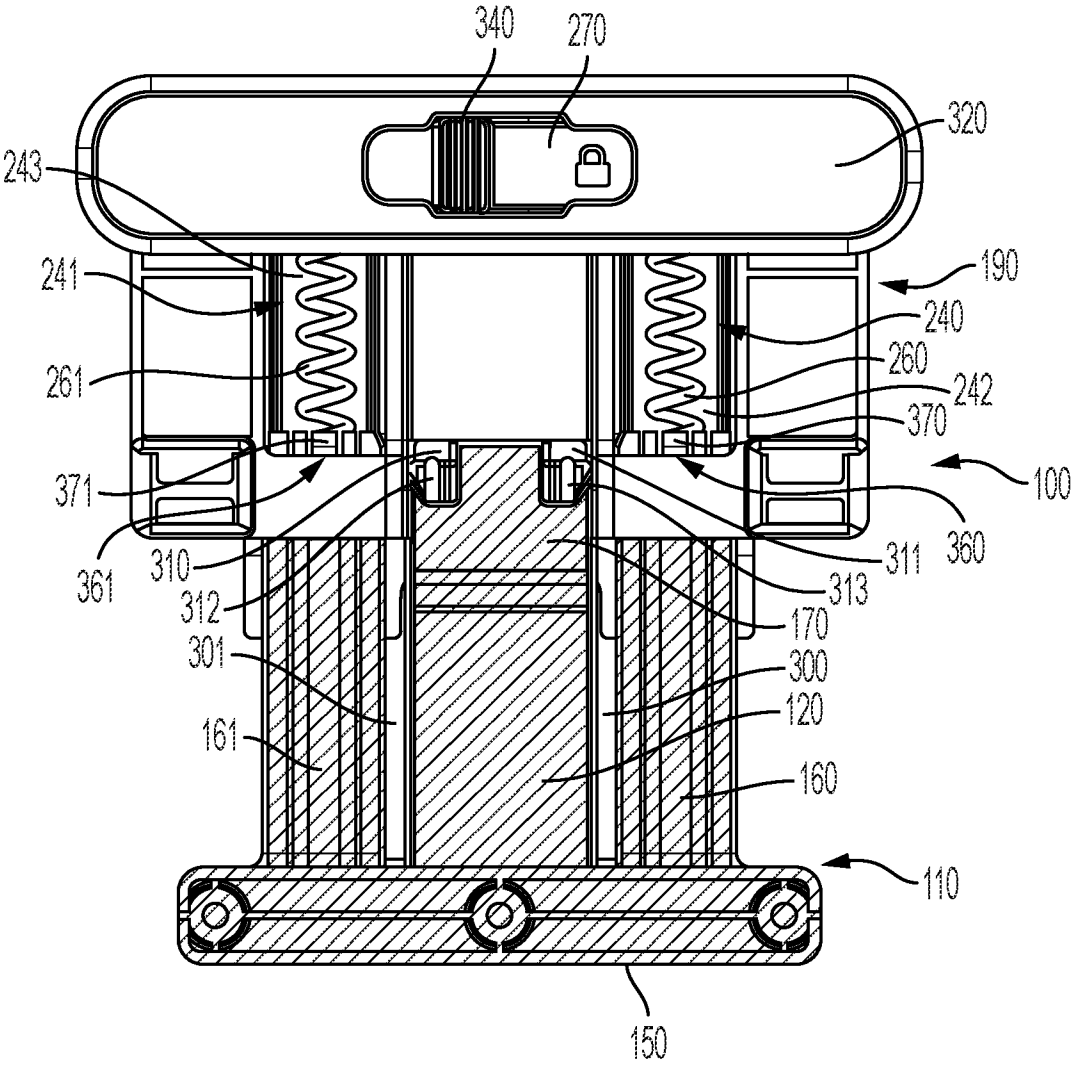
FIG. 1 is a plan view of the glide switch access side of a first embodiment of a compression and expansion device of the disclosure in an expanded configuration.
Figure 2:
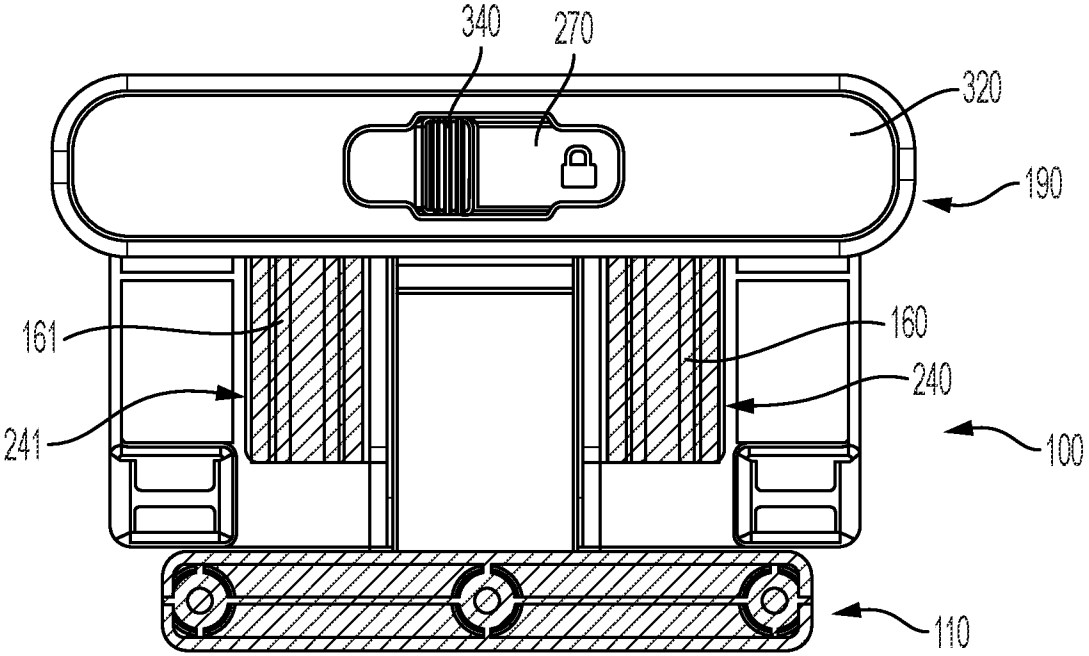
FIG. 2 is a plan view of the embodiment depicted in FIG. 1 in a compressed configuration.
Figure 3:
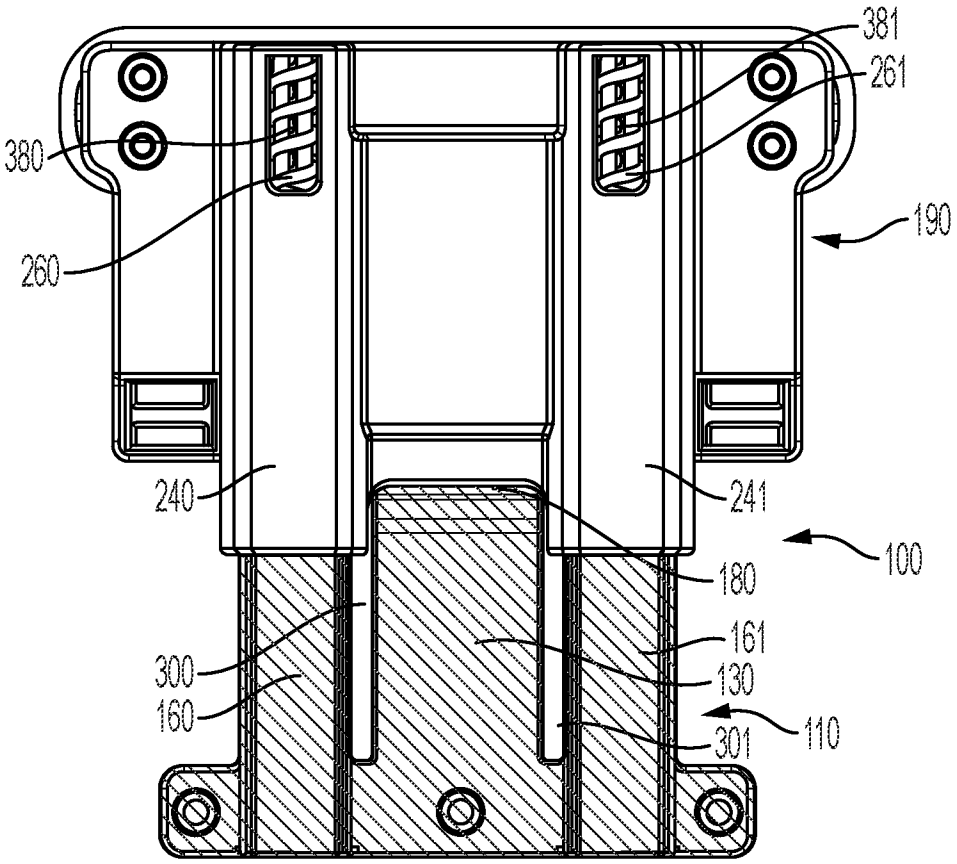
FIG. 3 is a plan view of the opposite side of the embodiment of FIG. 1 in an expanded configuration.
Figure 4:
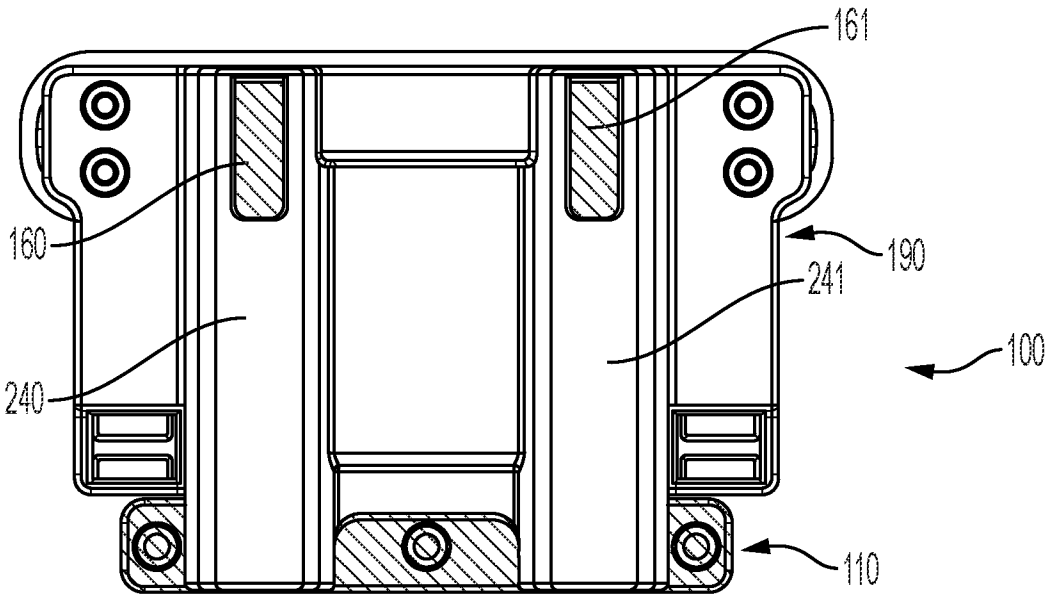
FIG. 4 is a plan view of the embodiment depicted in FIG. 3 in a compressed configuration.
Figure 5:
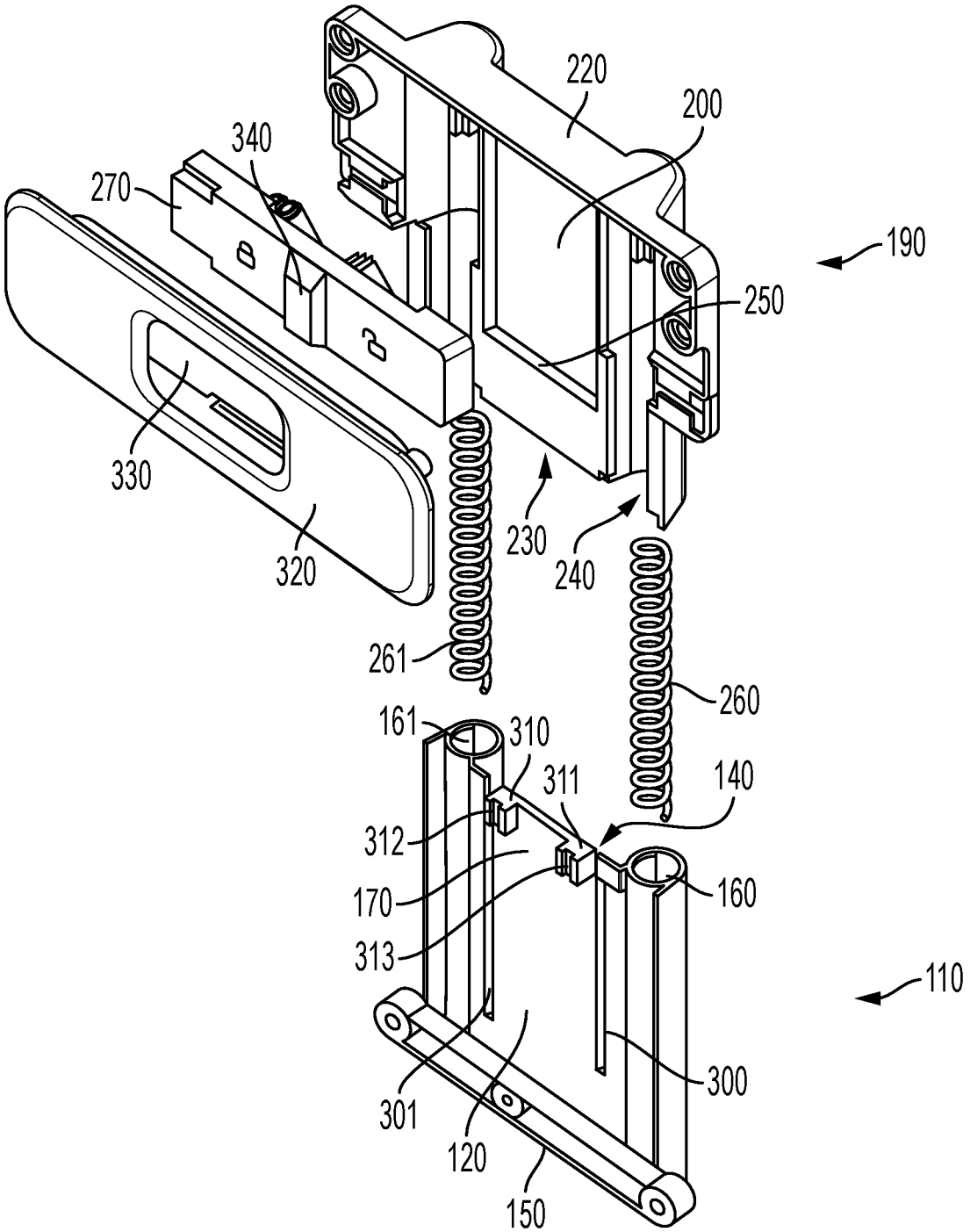
FIG. 5 is a perspective exploded view of the embodiment depicted in FIG. 1.
Figure 6:
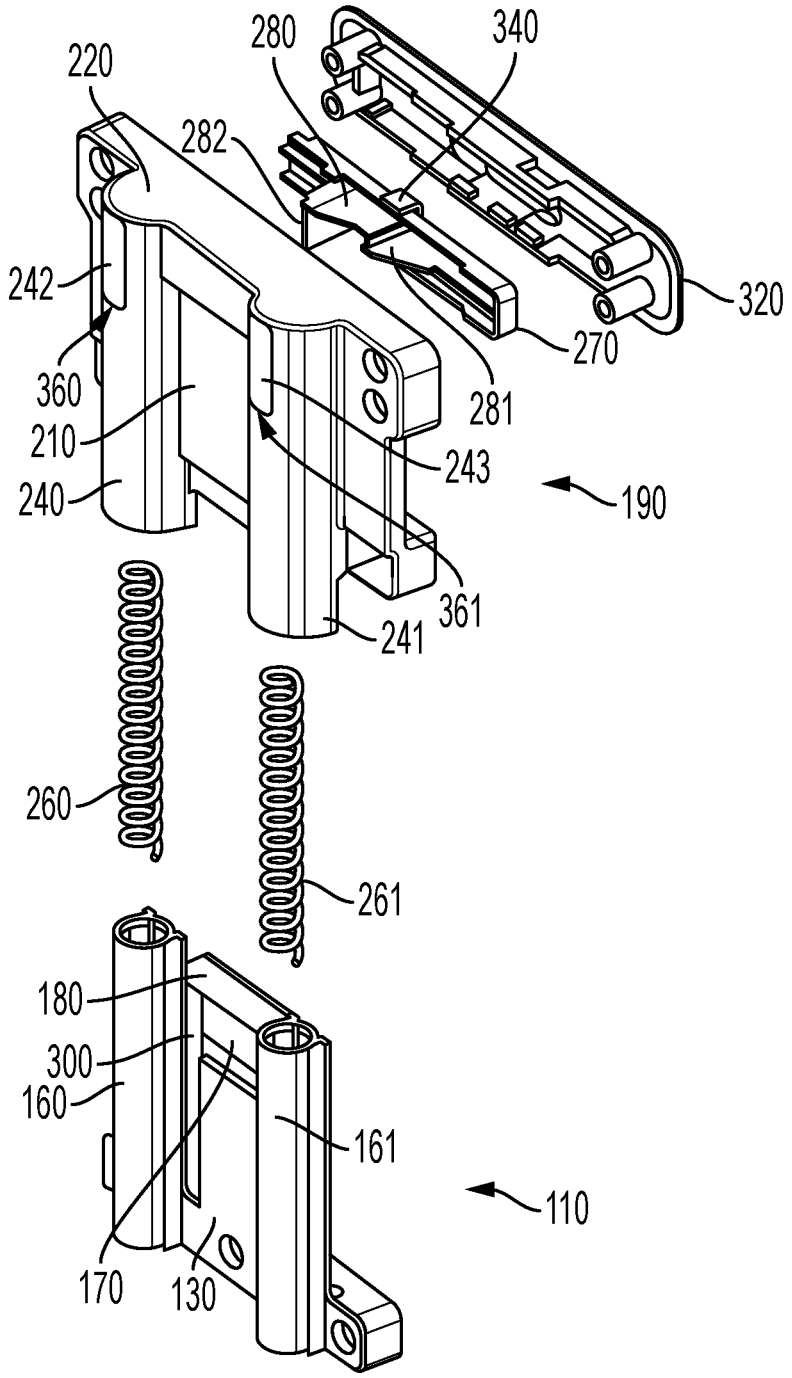
FIG. 6 is a perspective exploded view of the embodiment depicted in FIG. 3
Figure 7:
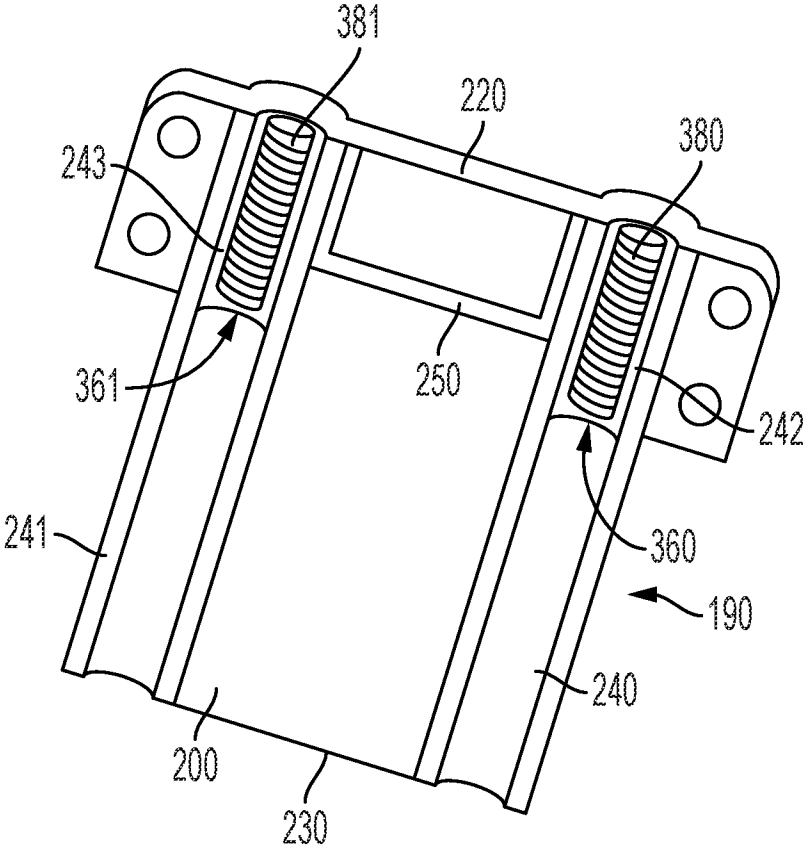
FIG. 7 is a perspective view of an expansion body for a first embodiment of the disclosure.
Figure 9:
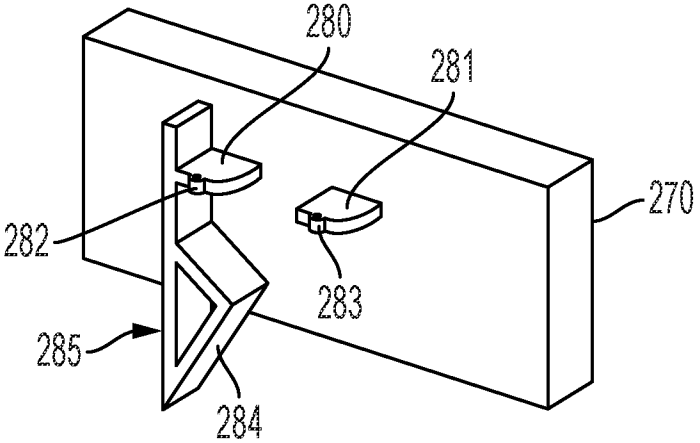
FIG. 9 is a perspective view of a glide switch for a first embodiment of the disclosure.
Figure 8:
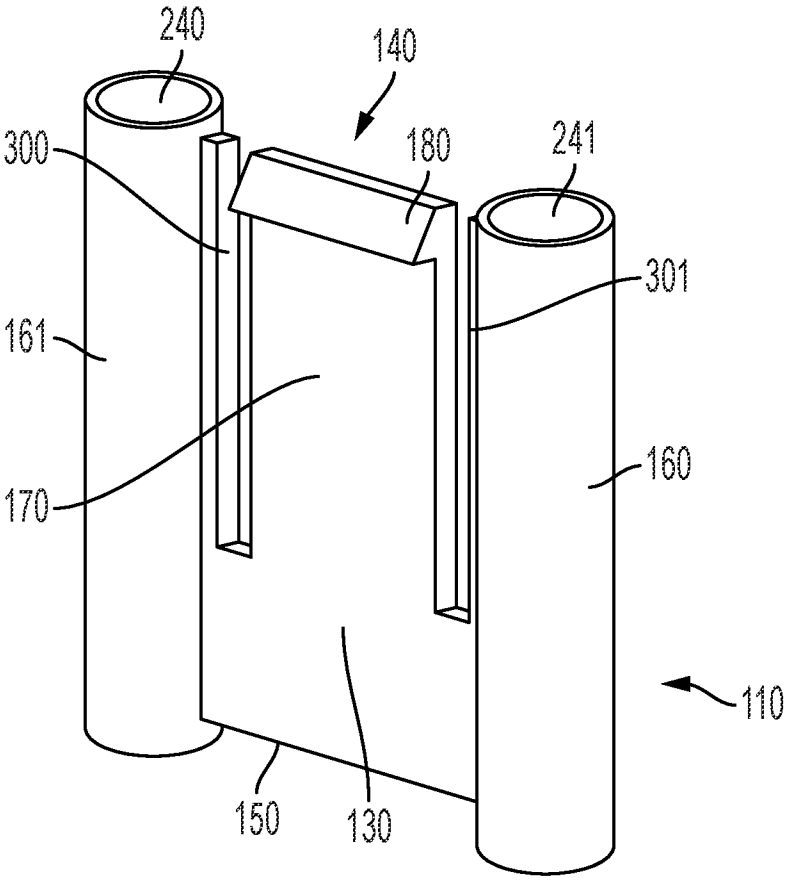
FIG. 8 is a perspective view of a base section for a first embodiment of the disclosure.

The ensuing detailed description is made with reference to the figures. This is for convenience only and is not limiting to the scope of the disclosure.

I. First Embodiment

Referring to FIGS. 1, 2, 3, 4, 5, 6, 7, 8, 9, 10A, 10B, 11A, and 11B thereat is depicted a first embodiment of a compression and expansion device 100 of the disclosure comprising a base section 110 which comprises a front face 120, a rear face 130, a top end 140, and a bottom end 150. As depicted, the base may be of generally rectangular shape although other shapes are contemplated. The base section comprises a pair of spaced apart, parallel passageways 160, 161 axially disposed (along the axis generally in the direction from the top end 140 to the bottom end 150) on the base section, and can extend along all or part of the base section. A flexible portion 170 is interposed between the pair of spaced apart parallel passageways 160, 161. This flexible portion can be integral with or a separate attachment to the base section 110. Flexible in this regard intends sufficient resiliency to bend (flex) in order to perform the lock and release function as described herein and return to its original shape. In the embodiment depicted, the flexible portion 170 is configured as a leaf spring. In this embodiment, the leaf spring configuration constituting flexible portion 170 is the area defined by and between a pair of slits 300, 301 which extend from the top end 140 toward the bottom end 150 and through the front face 120 and rear face 130. Flexible portion 170 comprises a protuberance 180 extending outwardly from the rear face 130. It is understood that the protuberance 180 can be of any shape or size as long as sufficient to achieve the functionality described herein and can it comprise one or more segments that can each be individually the same or different. In the non-limiting practice depicted, protuberance 180 is in the shape of a ridge extending outwardly from rear face 130.

In the first embodiment shown, expansion body 190 comprises an inner face 200, an outer face 210, an upper end 220, and a lower end 230. As depicted, the expansion body comprises a pair of spaced apart parallel conduit members 240, 241 axially disposed (along the axis generally in the direction of from the upper end 210 to the lower end 220) on the expansion body 190, and can extend along all or part of the expansion body 190. In the embodiment depicted, the inner face 200 of the expansion body 190 disposed opposite the rear face 130 of the base section 110. The expansion body 190 comprises a holding surface 250 interposed between the pair of spaced apart parallel conduit members 240, 241 on the inner face 200 of the expansion body 190. In one practice, protuberance 180 rests upon the holding surface 250 in a first position (P1) wherein the base section 110 and the expansion body 190 are in a compressed configuration (see e.g. FIG. 2).

It is understood that the holding surface 250 can be of any shape or size as long as sufficient to achieve the functionality described herein, e.g. it can comprise a ledge, a recess, and the like; and it can be comprised one or more segments that can each individually be the same or different in size and/or shape. In the non-limiting practice depicted, holding surface 250 is in the shape of a ledge. In the practice shown, ridge (protuberance 180) rests on the ledge (holding surface 250) in the compressed configuration (see FIGS. 10B, 11B). In the embodiment depicted, a pair of biasing members 260, 261 are each individually disposed within a respective passageway 160, 161 and its respective conduit member 240, 241. Biasing members as known in the art can be used; in the practice shown, the biasing members are each individually a coil spring. In one practice, each bias member, e.g. coil spring, is configured to urge the expansion body 190 away from the base section 110 to an expanded configuration (see FIGS. 10A, 11A).

In one practice, flexible portion 170 comprises at least one intermediary projection extending outwardly from the front face 120. The intermediary projection is configured to make contact with the push projection in lieu of the practice wherein the push projection directly contacts the face of the flexible portion directly (e.g. contacts that portion of flexible portion 170 that corresponds to the front face 120 of the base section from which the flexible portion 170 is comprised). The number of intermediary projections can, but need not, match the number of push projections. In the embodiment depicted, two push projections 280, 281 are shown, and two intermediary projections 310, 311 extend outwardly relative from the front face 120 of base section 110 and each are configured to sufficiently contact its respective push projection 280, 281 when the glide switch 270 is moved to the first position, and to sufficiently disengage from its respective push projection 280, 281 when the glide switch 270 is moved to the second position. In one optional practice (see FIG. 9), one or more of the push projections 280, 281 comprises an outwardly directed bump 282, 283 and at least one of the respective intermediary projections 310, 311 comprises a complimentary recess 312, 313 to secure the push projection to the flexible portion sufficient to reduce or prevent slippage between the two components when in the locked position. Glide switch 270 can comprise, in an optional practice (see FIG. 9) a downwardly extending generally triangular member 285 having a camming surface 284 as a side thereof. Functionally, camming surface 284 facilitates movement of the glide switch 270 to the unlocked position when the respective intermediary projection, e.g. 310, impinges upon it. The slope of camming surface of 284 facilitates movement of the glide switch 270 back to the unlocked position if it is accidentally slid into the locked position while the luggage is in the expanded configuration; when the user pushes the luggage closed to the compressed configuration, the glide switch moves back to an unlocked position so it can be moved back by the user to the locked position when the luggage is closed to the compressed configuration.

In one embodiment, the glide switch 270 is housed in a cover plate 320 secured to the upper end 220 of the expansion body 190, the cover plate 320 comprising an opening 330 through which the glide switch 270 can be accessed by a user in order to move the glide switch 270 to the locked position and/or the release position. The glide switch 270 can optionally comprise a grip member 340 which extends through opening 330 and with which grip member a user can move the glide switch to the locked position or the release position, e.g. using a finger or thumb.

Figure 10A:
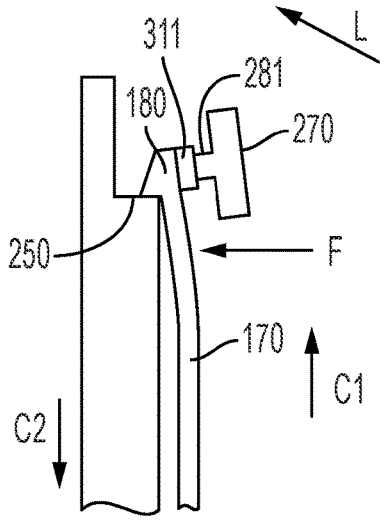
FIGS. 10A and 10B are partial schematic side views of a first embodiment of the disclosure showing operation of the flexible portion and glide switch with the compression expansion device locked in compressed configuration (FIG. 10A) and released in an expanded configuration (FIG. 10B).
Figure 10B:
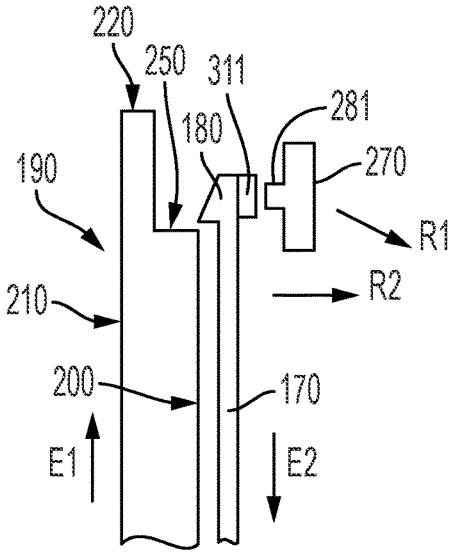
Figure 11A:
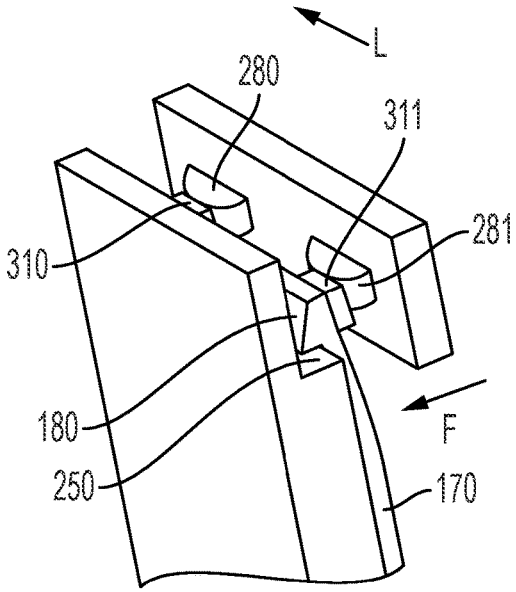
FIGS. 11A and 11B are perspective views of FIGS. 10A and 10B, respectively.
Figure 11B:
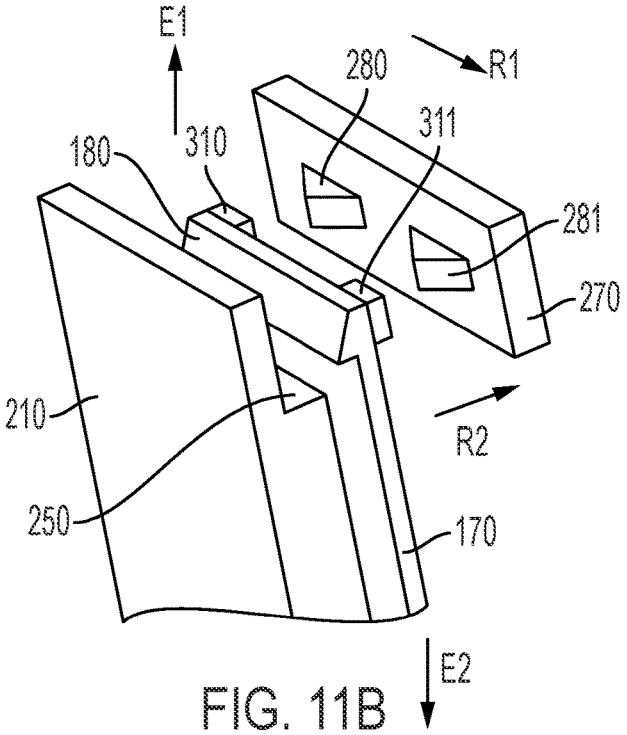

Operationally: the non-limiting practices of FIGS. 10A, 10B, 11A, and 11B show aspects of a device of a first embodiment in locked in a compressed configuration. Operationally, the base section 110 (of which only the flexible portion 170 is depicted) and/or the expansion body 190 (partially depicted) are moved (compressed) in the directions shown by arrows C1 and C2. Glide switch 270, having push projections 280, 281, is moved in the direction of arrow L whereby the push projections 280, 281, contact intermediary projections 310, 311 sufficient to cause the flexible portion leaf spring 170 to bend (flex) in the direction of arrow F whereby ridge 180 is forced to rest on ledge 250 of the expansion body 190. In one practice, glide switch 270 remains in place by pressure fit, e.g. by being secured in housing 320 (not shown) which prevents movement once the glide switch is locked in the compressed configuration, the pressure of the flexible portion in the direction opposite arrow F keeping it in place. FIGS. 10B and 11B show the release and expansion configuration of the embodiment. Here, glide switch 270 is moved in the direction of arrow R1, which causes the flexible portion (e.g. leaf spring 170) to return to its unflexed position in the direction of arrow R2 thereby causing push projections 280, 281 to disengage from intermediary projections 310, 311 sufficient to displace ridge 180 from ledge 250 whereby the base section 110 and/or the expansion body 190 move in the directions of arrows E1, E2.

In an optional practice, and the pair of spaced apart parallel conduit members 240, 241 axially disposed on the expansion body each individually comprise a slot 242, 243 disposed along all or part of the length of the respective passageway, each slot having a first closed end 360, 361 proximate the top end 220 of the expansion body 190; the pair of spaced apart, parallel passageways 160, 161 axially disposed on the base section each individually comprise a stop projection 370, 371 configured to extend through a respective slot 242, 243 sufficient to respectively contact the first closed ends 360, 361 to halt the movement of the expansion body 190 away from the base section 110 either at a designated stopping point, or to prevent disassembly of the base section 110 from the expansion body 190. In one practice, the pair of spaced apart parallel passageways 160, 161, are each individually of generally cylindrical shape, although other shapes suitable for sliding engagement may be employed, and extend outwardly in part from the rear face 130 of the base section 110; and the pair of spaced apart parallel conduit members 240, 241 are each individually of generally cylindrical shape, although other shapes suitable for sliding engagement may be employed, and extend outwardly in part from the outer face 210 of the expansion body 190. In an optional practice, a pair of stabilizer post projections 380, 381 each individually extend into a respective one of the spaced apart parallel conduit members 240, 241 from the upper end 220 of the expansion body 190 and each post 380, 381 is configured to fit axially within a respective coil spring 260, 261.

The expansion body and base of the compression expansion device for the embodiments and practices described herein, as well as their component parts, may comprise any suitable material of construction or combinations of such materials, including without limitation materials that are rigid or semi-rigid. Representative materials of construction comprise plastic, including without limitation plastics exemplified by polyoxymethylene copolymer (POM-C) high rigidity grade, or metal.

II. Second Embodiment

Figure 12:
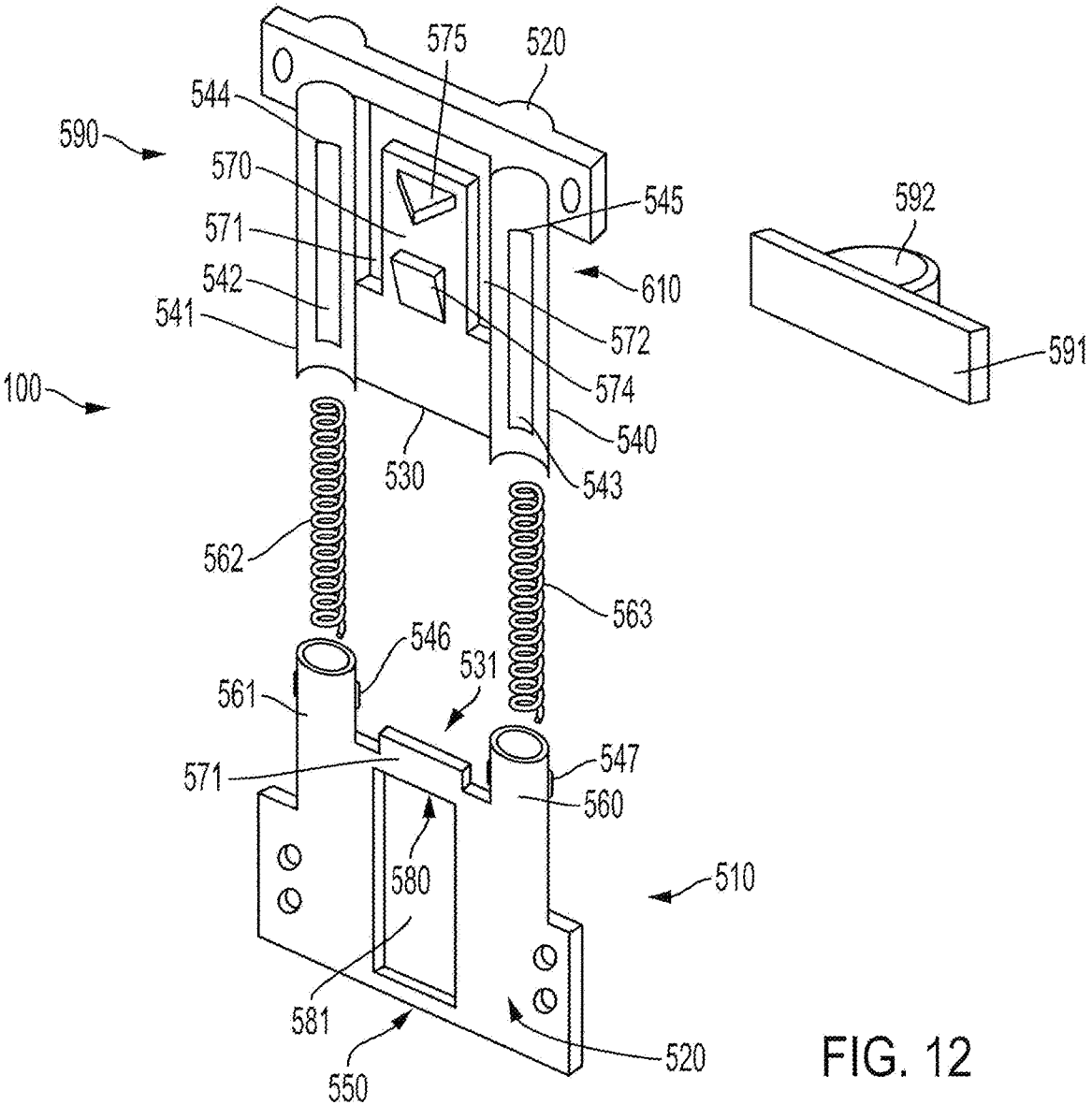
FIG. 12 is a perspective exploded view of a second embodiment of a compression and expansion device of the disclosure.
Figure 13B:
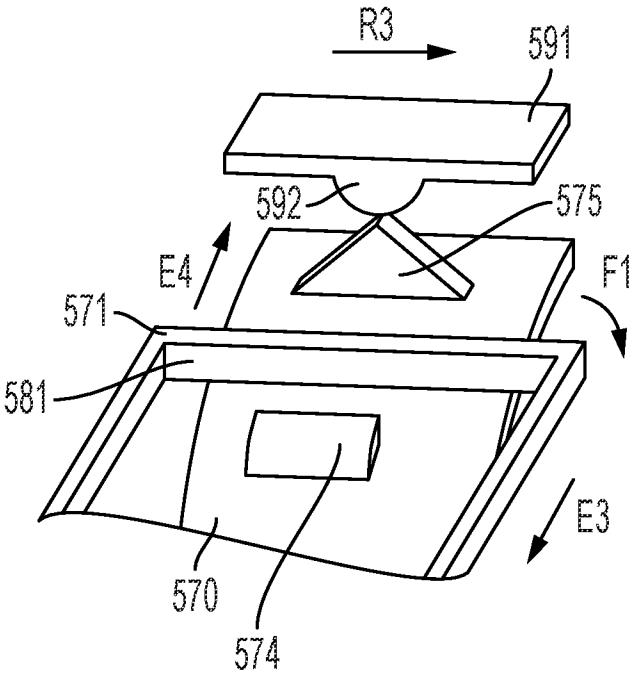
FIGS. 13A and 13B are partial perspective views of views of a second embodiment of the disclosure showing operation of the flexible portion and glide switch with the compression expansion device in locked (FIG. 13A) and expanded (FIG. 13B) configurations.
Figure 13A:
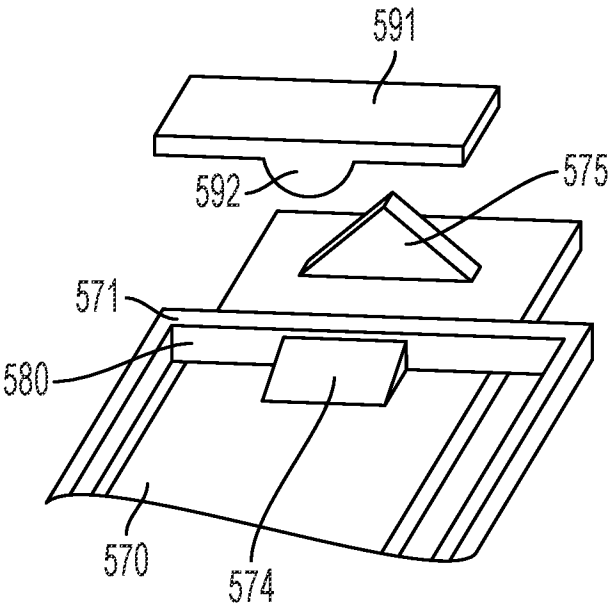

Additional reference to FIGS. 12, 13A, 13B is made whereat is depicted a second embodiment of a compression and expansion device 100 of the disclosure is depicted. Elements in common with the first embodiment hereinabove are further described there and are incorporated herein by reference including discussion of FIGS. 1-11 inclusive. Turning to FIGS. 12, 13A, 13B, the second embodiment depicted comprises a base section 510 which comprises a front face 520, a rear face 530, a top end 531, and a bottom end 550. A pair of spaced apart, parallel passageways 560, 561 axially disposed on the base section, and a holding surface 580 disposed between the pair of spaced apart, parallel passageways 560, 561. In the non-limiting practice depicted, holding surface 580 is the underside of arch 571 which can fully or partially span passageways 560, 561. In the practice shown, area 581 is open; in another practice (not shown), area 581 is filled and holding surface 580 can comprise the underside of a ledge. As depicted, expansion body 590 comprises an inner face 600, an outer face 610, an upper end 520, and a lower end 530. A pair of spaced apart parallel conduit members 540, 541 are axially disposed on the expansion body, each of the pair of spaced apart parallel conduit members individually mated in a slidable manner with a respective spaced apart parallel passageway 560, 561 of the base section 510; as shown, the inner face 600 of the expansion body 590 is disposed opposite the rear face 530 of the base section 510.

Expansion body 590 comprises a flexible portion 570 disposed between the pair of spaced apart parallel conduit members 540, 541. The flexible portion 570 comprises at least one protuberance 574 extending outwardly from inner face 600, and at least one release protrusion 575 extending outwardly from the inner face 600 of the expansion body 590. In the practice depicted, protuberance 574 is shown as a ridge; other shapes and sizes of protuberances can be employed and a single or multiple protuberances can be used. In one practice, the release protrusion 575 is axially spaced from the protuberance 574 (along the axis generally in the direction of from the upper end 520 to the lower end 530, including along the same such axis), and in another practice release protrusion 575 extends outwardly beyond the protuberance 574. In one practice, as shown, release protrusion is located proximate the upper end 520 of expansion body 590 and is on the same vertical axis as protuberance 574 which is located beneath release protrusion 575 distal from the upper end 520. In the practice shown, release protrusion 575 has a generally triangular cross section when viewed from upper end 520; other shapes and sizes of release protrusions can be employed and a single or multiple such release protrusions can be used. In the practice illustrated, a pair of biasing members 562, 563, shown as coil springs, are each individually disposed within a respective passageway and its respective conduit member, and each individually urges the expansion body 590 away from the base section 510 to an expanded configuration. A glide switch 591 is disposed opposite from and movable across the release projection 575, the glide switch 591 comprises a push projection 592 which is configured to sufficiently contact the release protrusion 575 to displace the protuberance 574 from the holding surface 580 to a second position when the glide switch 591 is moved to a release position whereby the base section 510 and expansion body 590 assume the expanded configuration.

As shown in the non-limiting practice in FIGS. 13A and 13B: FIG. 13A depicts the base section 510 (only the arch 571 being depicted) and the expansion body 590 (only the flexible portion being depicted) in a compressed configuration wherein protuberance 574 is resting on holding surface 580, which is the underside of arch 571); push projection 592 is shown on one side of the release projection 575 (it could be on the other side, not depicted, as glide switch 591 is configured to traverse across the release projection 575. FIG. 13B depicts the release operation: as shown, glide switch 591 is moved in the direction of arrow R3, causing push projection 592 to contact release projection sufficient 575 to bend (or flex) the flexible portion 570 in the direction of arrow F1 whereby protuberance 574 disengages from holding surface 580 sufficient for the base section and expansion body to assume an expanded configuration, shown in FIG. 13B by base section (only arch 571 being depicted) moving in the direction of arrow E3 and/or the expansion body (only the flexible portion 570) moving in the direction of arrow E4.

As in the first embodiment, the flexible portion 570 can be configured as a leaf spring. In the practice depicted in FIGS. 12-13, the leaf spring configuration constituting flexible portion 170 is the area defined by and between a pair of slits 5721, 572 which extend from proximate the upper end 520 toward the lower end 530, and through the inner 600 and outer face 610 of expansion body 590. In one practice, the glide switch 591 is housed in a cover plate (as shown as 320 in FIGS. 1 and 5 but not shown in FIGS. 12-13) which cover plate is attached to the upper end of the expansion body, the cover plate having an opening through which the glide switch is accessed by the user to move the glide switch to the locked position or the release position.

In one practice, the glide switch 591 is housed in a cover plate (as shown as 320 in FIGS. 1, 5 but not shown in FIGS. 12-13) secured to the upper end 220 of the expansion body 190, the cover plate 320 comprising an opening (as shown as 330 in FIGS. 1, 5 but not shown in FIGS. 12-13) through which the glide switch 591 can be accessed by a user in order to move the glide switch 591 to the locked position and/or the release position. The glide switch 591 can optionally comprise a grip member (as shown as 340 in FIGS. 1, 5 but not shown in FIGS. 12-13) which extends through opening and with which grip member a user can move the glide switch to the locked position or the release position, e.g. using a finger or thumb.

In one practice, the pair of spaced apart, parallel conduit members 540, 541 disposed on the expansion body section 590 each individually comprise a slot 542, 543 disposed along all or part of the length of the respective passageway, each slot having a first closed 544, 545 end proximate the upper end 520, the pair of spaced apart parallel passageways 560, 561 axially disposed on the base section 510 each individually comprise a stop projection 546, 547 configured to extend through a respective slot 542, 543 sufficient to contact the first closed end 544, 545 and halt the movement of the expansion body 590 away from the base section 510 either at a designated stopping point, or to prevent disassembly of the base section 510 from the expansion body 590. In one practice, the pair of spaced apart parallel passageways 560, 561 are each individually of generally cylindrical shape, although other shapes suitable for sliding engagement may be employed, and extend outwardly in part from the rear face 530 of the base section 510; and the pair of spaced apart parallel conduit members 540, 541 are each individually of generally cylindrical shape, although other shapes suitable for sliding engagement may be employed, and extend outwardly in part from the outer face 610 of the expansion body 590. In an optional practice, a pair of stabilizer post projections are provided (shown as 380, 381 in FIG. 2 but not shown in FIGS. 12-13) which each individually extend into a respective one of the spaced apart parallel conduit members 540, 541 from the upper end 520 of the expansion body 590, each such post configured to fit axially within a respective coil spring to stabilize the spring during use.

Referring to FIGS. 14A, 14B, 14C, and 14D depicts an embodiment of an article of luggage contemplated by the disclosure embodying a compression-locking device of the disclosure, e.g. as shown in FIGS. 1-11 and 12-13. In a non-limiting practice, article of luggage 1400 comprises a main luggage body 1440 having a bottom surface 1441 forming a cavity to receive articles for packing. The article of luggage further comprises an expansion portion 1420 having a perimeter defining a cavity. Foldable gusset 1430 joins main luggage body 1440 to expansion portion 1420. Foldable gusset 1430 allows the expansion portion 1420 to move away from luggage main body 1400 in order to expand the volume formed by the cavity of the luggage main body 1440 and the cavity of the expansion portion 1420. Gusset 1430 can be foldable or compressible and can comprise cloth or other suitable material. Cover 1410 is attached to the expansion portion 1420 and is sealable and openable by e.g. zippers and the like. Article of luggage 1400 can be soft-sided or hard-sided or combinations of both and can comprise materials of construction including cloth, metal and plastic. Article of luggage 1400 can comprise wheels as known in the art, e.g. spinner wheels 1490 or rolling wheels (not shown) or feet (not shown) or any combination of the foregoing and can comprise one or more handles (not shown) including a telescoping handle attached to main luggage body 1440 of the expansion portion 1420. In different embodiments, the at least one compression expansion device 100 as described herein can be disposed at an inner internal wall of the article of luggage or on an outer external wall of the luggage. Multiple such devices can be installed, e.g. two devices, each at opposing inner walls or opposing outer walls. In one practice, the glide switch which activates expansion and which locks the luggage in a compressed configuration is accessible from an outer wall, e.g. the glide switch and grip member if present is accessible to the user without opening the luggage, e.g. the user can move the glide switch from a locked position (compressed) to an unlocked (expanded) position and vice-versa because the glide switch is located on or accessible from an outer, external wall surface of the luggage while the remaining components are within the luggage.

Figure 14A:
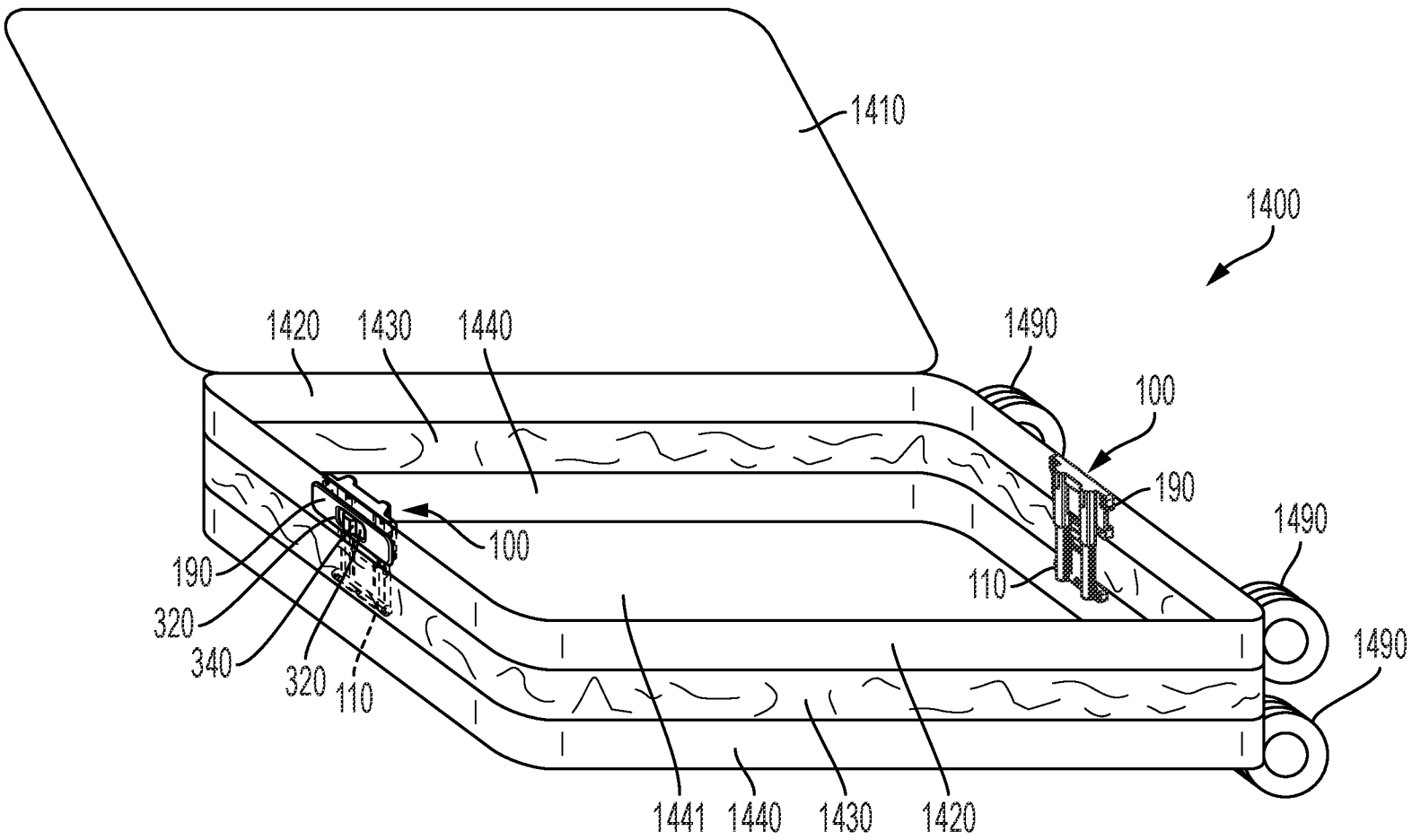
FIGS. 14A, 14B, 14C, 14D are perspective views of the internal area of an embodiment of an article of luggage of the disclosure employing a compression expansion locking device of the disclosure, wherein two devices are placed internally, on opposite inner walls of the luggage and the glide switch is accessible from the outside of the luggage (FIGS. 14A, 14B) and wherein two devices are placed externally on opposite outside walls (FIG. 14C, 14D).

As shown in the practice of FIG. 14A two compression expansion devices 100 are disposed internally at respective opposite inner walls of the article of luggage 1400; in the practice shown base section 110 is affixed to the main luggage body 1440 and expansion body 190 is affixed to the expansion portion 1420 of luggage 1400; these affixations can be the reversed for both devices 100 or for only one of the two devices 100. In other practices, one or more than two compression expansion devices and such devices of different embodiments as described herein can be used. As shown in FIG. 14A, the compression expansion device 100 can comprise, for example, as described herein, a base section 110 and expansion body 190, each affixed to one of the luggage main body or the expansion body. As described herein the base section 110 and expansion body 190 are disposed in sliding relation to each other and engaged with at least one bias member, e.g. two coil springs which urge the base section 110 and expansion body 190 away from each other in an expanded configuration.

In a first embodiment, as described hereinabove and incorporated herein, the base section comprises a flexible portion, the flexible portion comprising a protuberance facing the expansion body, the expansion body comprising a holding surface complimentary to the protuberance and on which the protuberance rests in a first position wherein the base section and the expansion body are in a compressed configuration; and a glide switch 320 disposed opposite from and moveable across the protuberance, the glide switch 320 comprising a push projection configured to (i) sufficiently contact the flexible portion to urge the protuberance to rest on the holding surface in the first position whereby the base section and expansion body are in the compressed configuration when the glide switch is moved to a locked position, and (ii) sufficiently disengage from the flexible portion to displace the protuberance from the holding surface to a second position when the glide switch is moved to a release position whereby the base section and expanded portion assume the expanded configuration. Glide switch 320 and grip member 340 are accessible from the outer wall of either the main luggage body or the expansion portion so that a user does not have to open the luggage in order to expand or compress it.

In a second embodiment, as describe above and incorporated herein, the expansion body of the device comprises a flexible portion, the flexible portion comprising a protuberance and a release protrusion both facing the base section, the release protrusion axially spaced from and extending outwardly beyond the protuberance, the base section comprising a holding surface complimentary to the protuberance and on which the protuberance rests in a first position wherein the base section and the expansion body are in a compressed configuration; and a glide switch 32 is disposed opposite from and movable across the release projection, the glide switch comprising a push projection configured to sufficiently contact the release protrusion to displace the protuberance from the holding surface to a second position when the glide switch is moved to a release position whereby the base section and expanded portion assume the expanded configuration. As shown in FIG. 14A, glide switch 320 is accessible from the outer wall of either the main luggage body or the expansion portion so that a user does not have to open the luggage in order to expand or compress it.

Figure 14B:
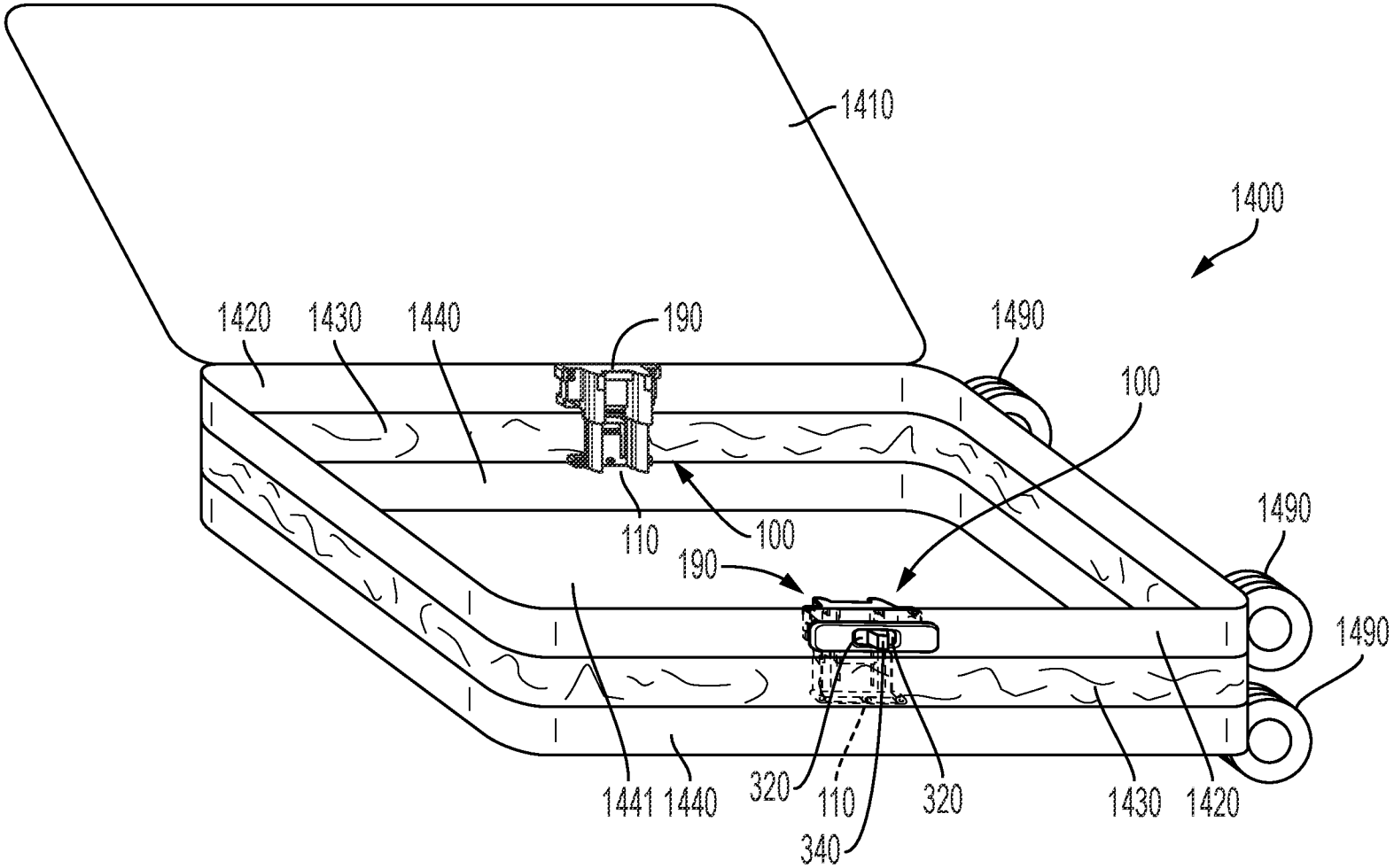
Figure 14C:
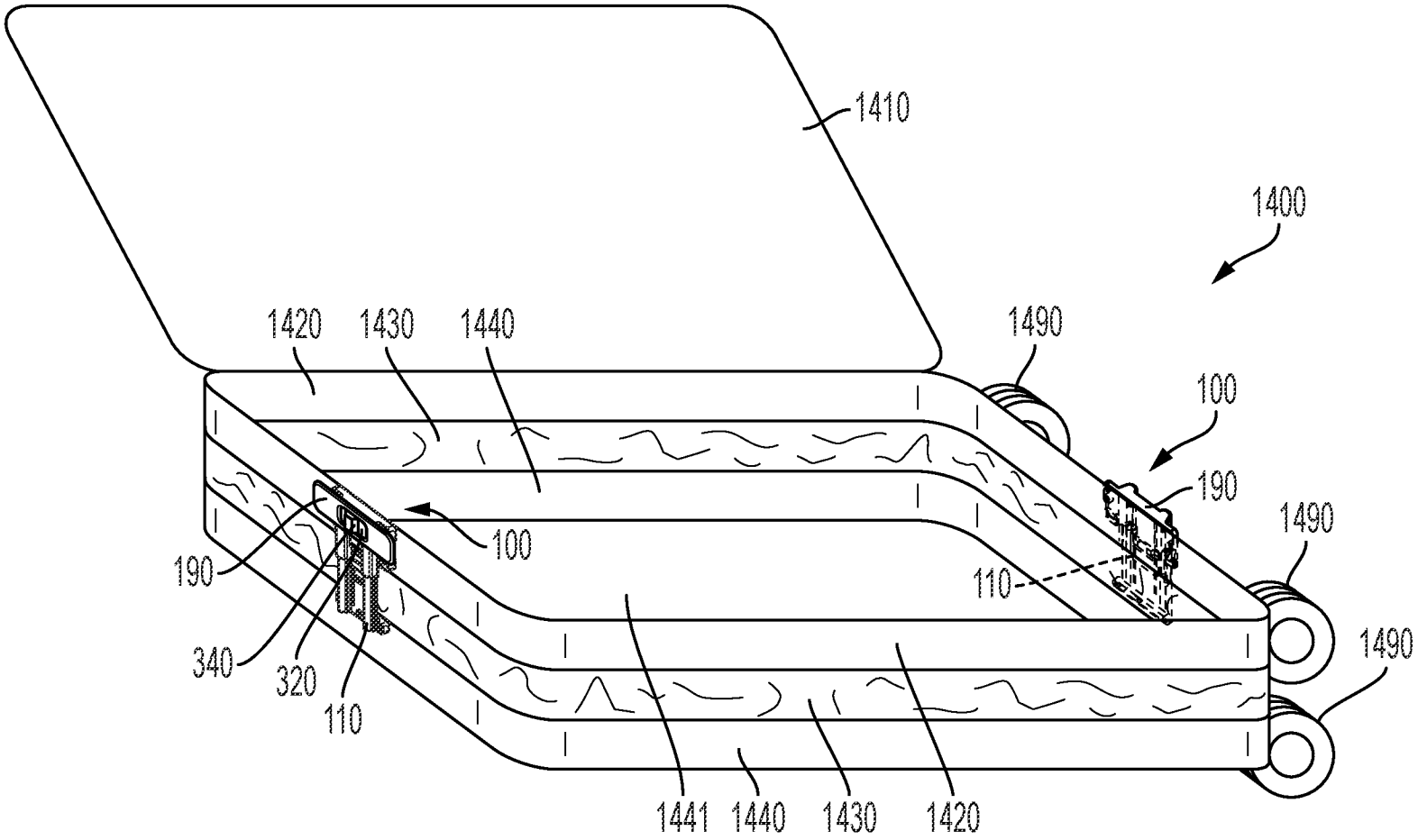
Figure 14D:
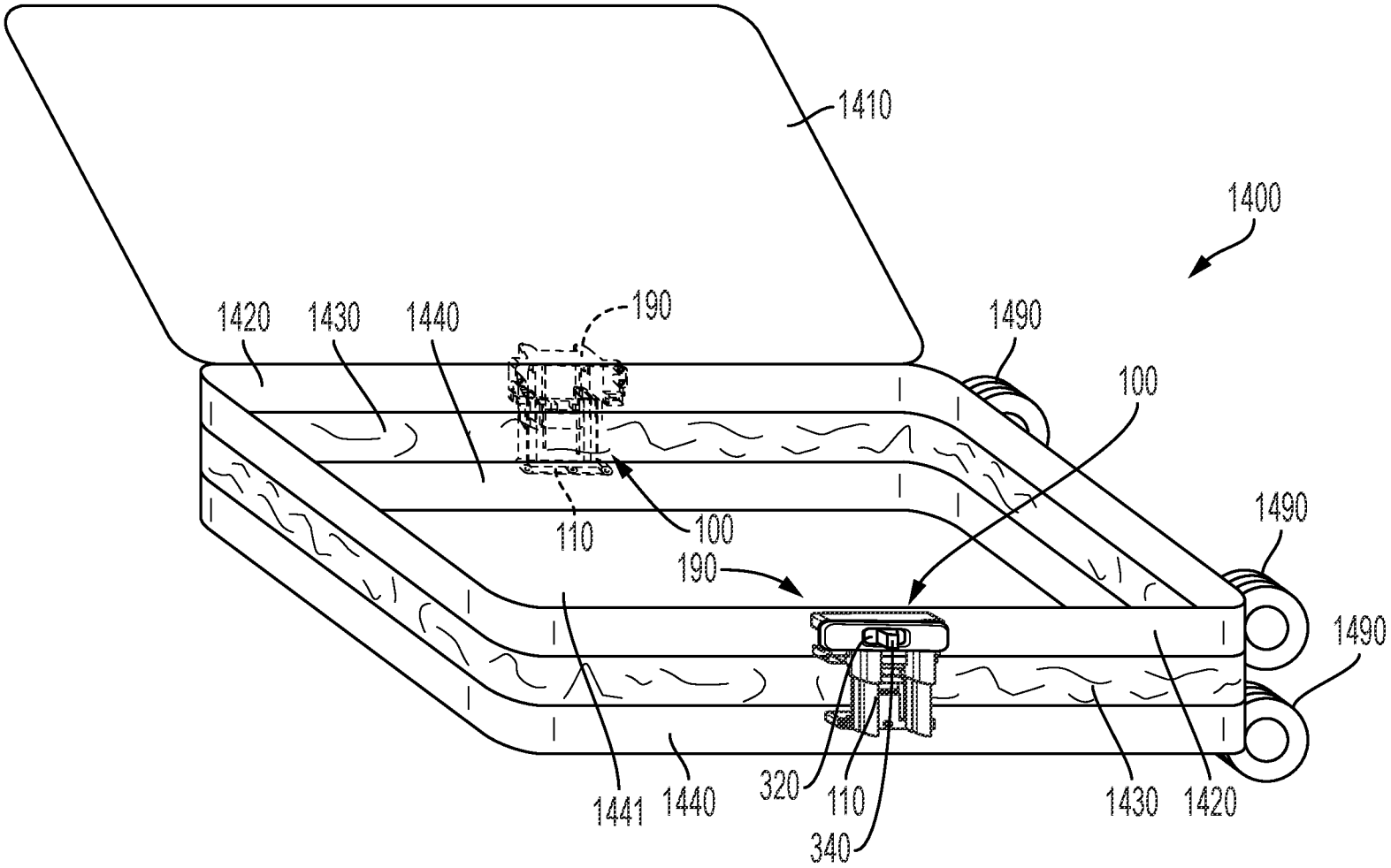

FIG. 14A depicts a practice wherein two compression expansion devices 100 are employed, with one affixed to an internal side of the wall on which the wheels 1490 are located (the bottom wall of the luggage article is upright, i.e. with the wheels 1490 are on the ground) and a second device 100 is affixed to the internal side of the opposite wall (the top wall when the luggage article 1400 is upright). FIG. 14B depicts another practice wherein two compression expansion devices 100 are employed, with one affixed to an internal side of the wall that is vertical to the wall on which the wheels 1490 are located (the vertical side of the luggage article when it is upright and a second device 100 is affixed to the internal side of the opposite vertical wall. FIG. 14C depicts yet another practice wherein two compression expansion devices 100 are employed, with one affixed to the outside of the wall on which the wheels 1490 are located (the bottom wall of the luggage article is upright, and a second device 100 is affixed to the outside of the opposite wall (the top wall when the luggage article 1400 is upright). FIG. 14D depicts still another practice wherein two compression expansion devices 100 are employed, with one affixed to the outside of the wall that is vertical to the wall on which the wheels 1490 are located (the vertical side of the luggage article when it is upright) and a second device 100 is affixed to the outside of the opposite vertical wall. When a compression expansion device 100 is located on an external outer wall, coverings may be employed to protect the device.

Figure 15A:
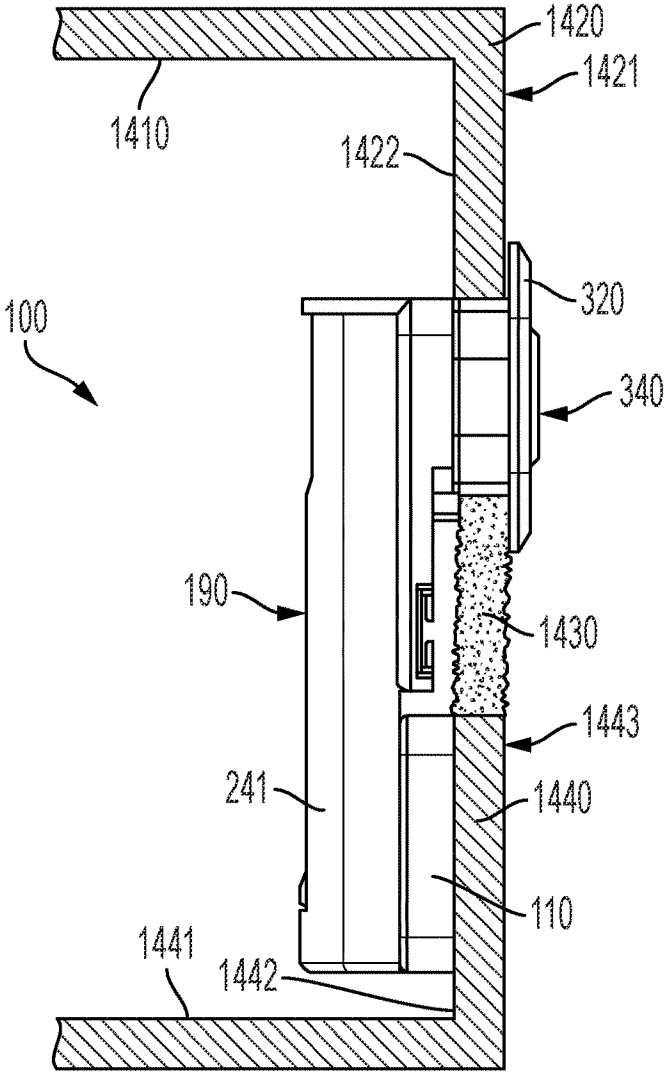
FIG. 15A is a cross sectional view (partial) of an article of luggage comprising a compression expansion device in a compressed configuration.
Figure 15B:
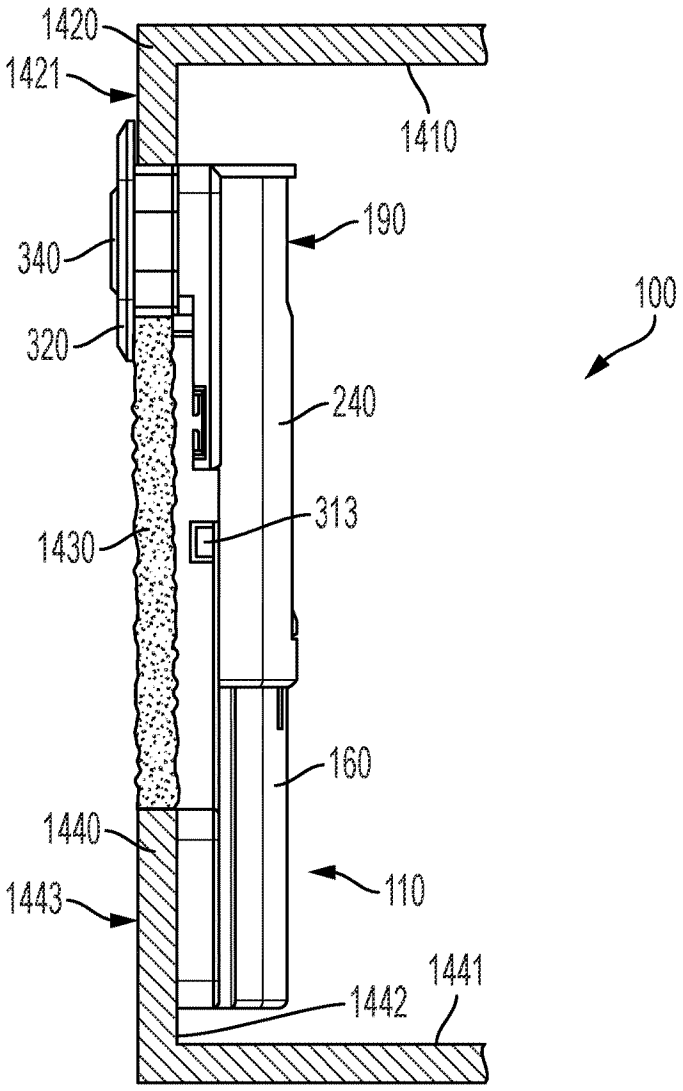
FIG. 15B is a cross sectional view of FIG. 15A from the opposite side in an expanded configuration.

FIG. 15A depicts a partial cross section of an article of luggage comprising a compression expansion device 100 with base section 110 affixed to an inner wall 1422 of the main luggage body 1440 and expansion body 190 affixed to a the corresponding inner wall 1442 of the expansion portion 1420. Compression expansion device is in the compressed configuration in FIG. 15 with gusset 1430 in an unexpanded state. As depicted, grip member 340 on the glide switch (which is in the locked position and is obscured in the view of FIGS. 15A and 15B) with cover plate 320 is accessible from the outer wall 1421 of main luggage body 1440. FIG. 15B depicts the article of luggage of FIG. 15A (viewed from the other side) after the glide switch (obscured from view) after it has been moved to the release position via grip member 340. Gusset 1430 is in an expanded state thus increasing the volume of the article of luggage.

Figure 16B:
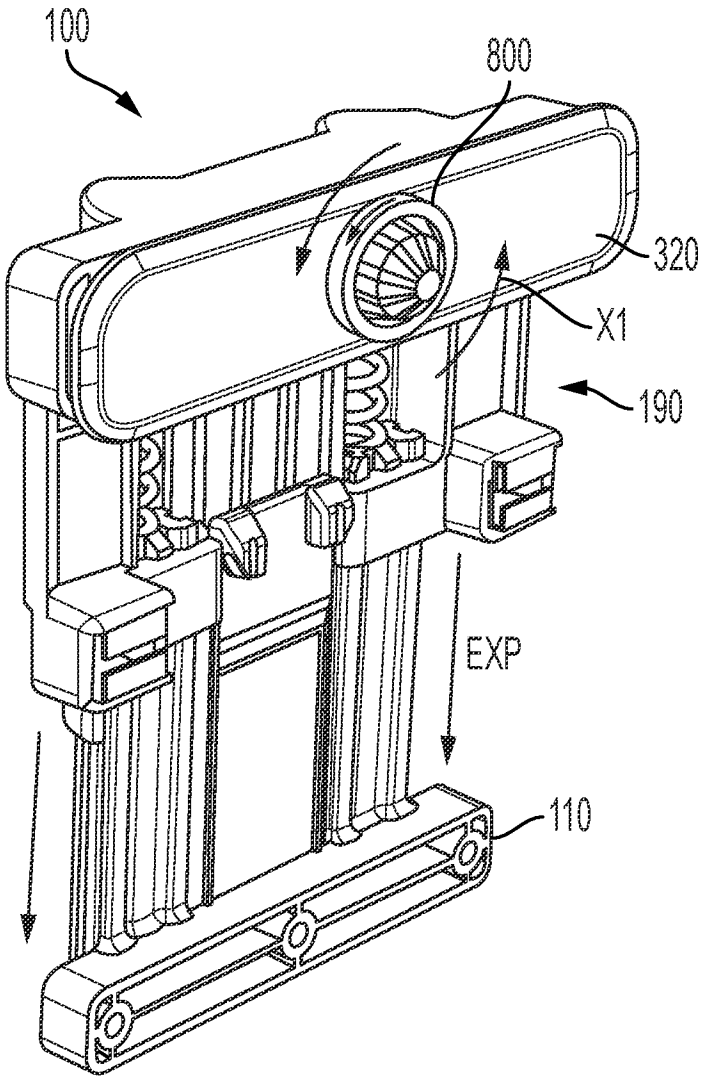
FIGS. 16A to 16N are perspective views of additional non-limiting embodiments of the disclosure of different activation members with the compression expansion device in compressed and expanded configurations, including wherein the activation member is a dial member (16A, 16B), a twist member (16C, 16D), a lever member (16E, 16F), a lift member (16G, 16H), a squeezable member (16I, 16J), a car-door like member (FIG. 16K, 16L), and a pull out member (FIG. 16M, 16N).
Figure 16A:
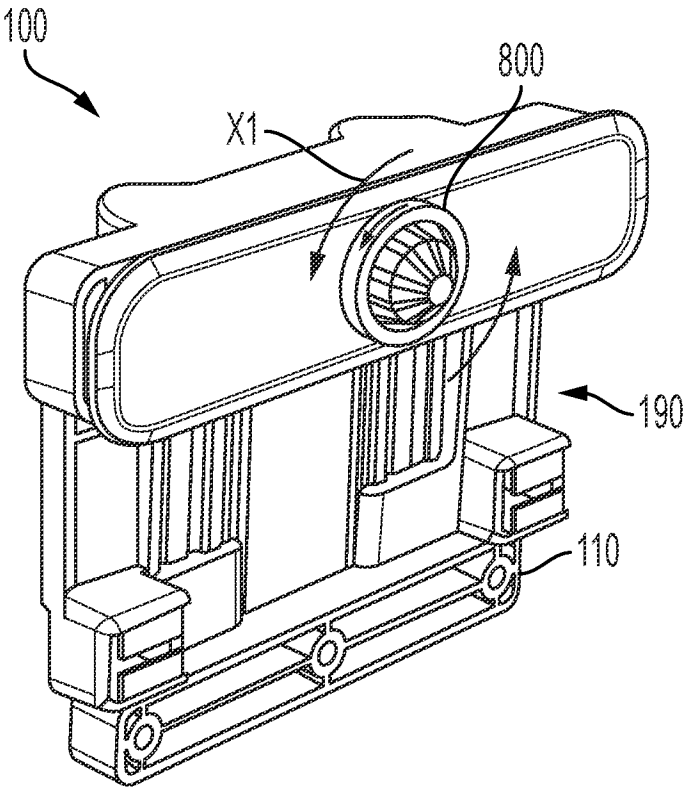
Figure 16D:
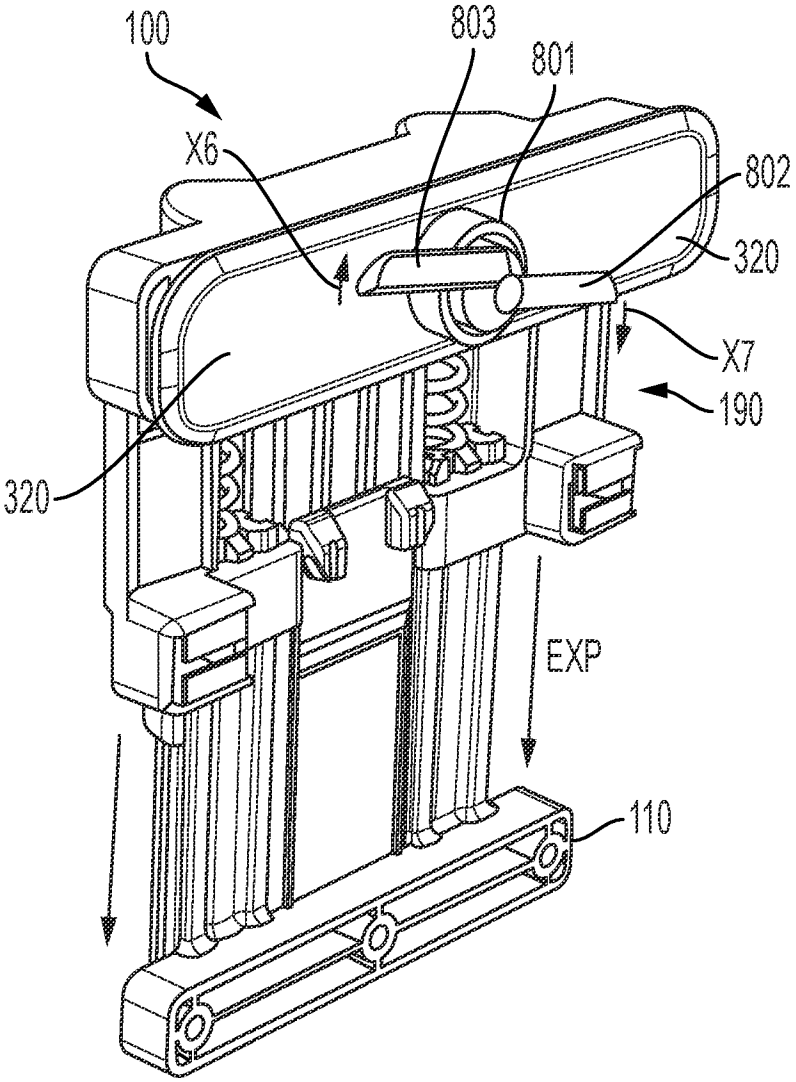
Figure 16C:
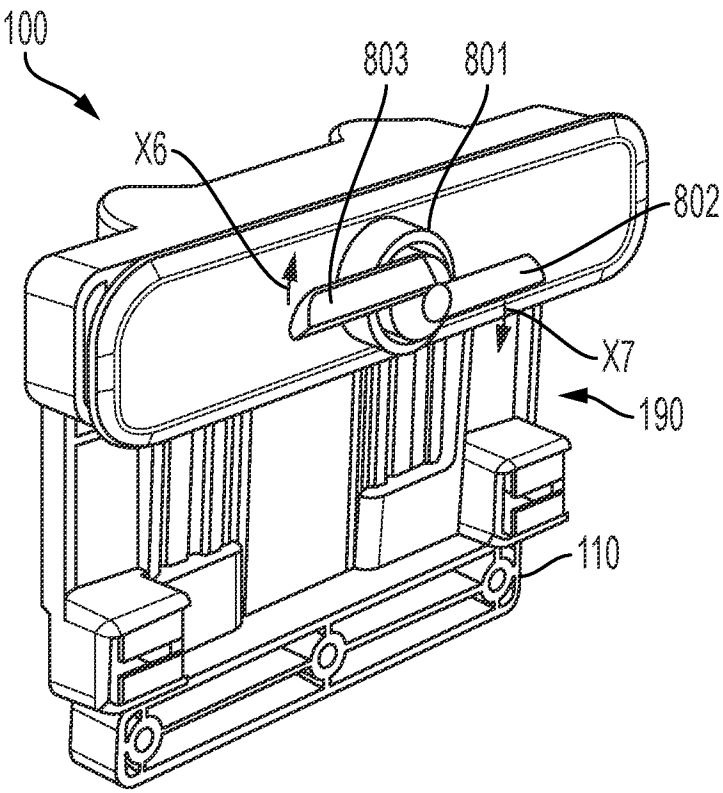
Figure 16F:
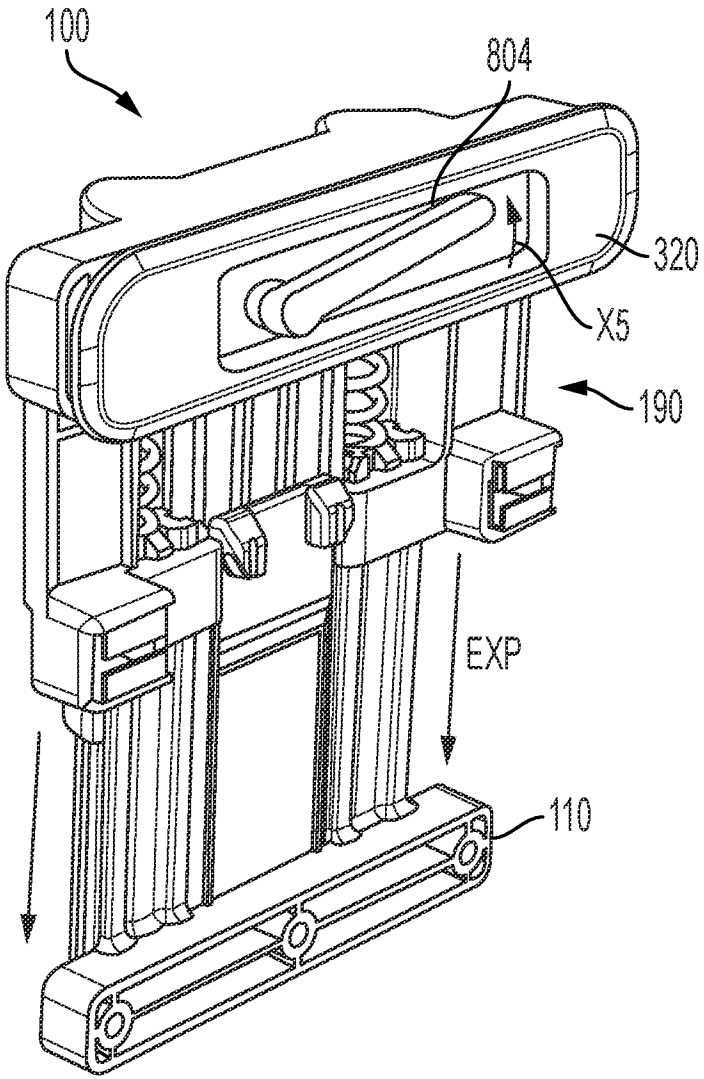
Figure 16E:
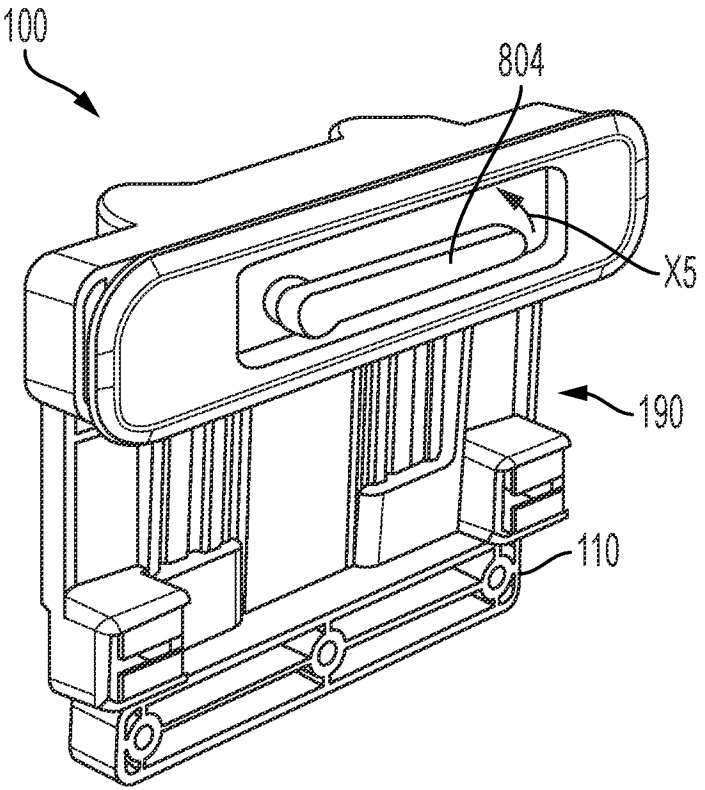
Figure 16H:
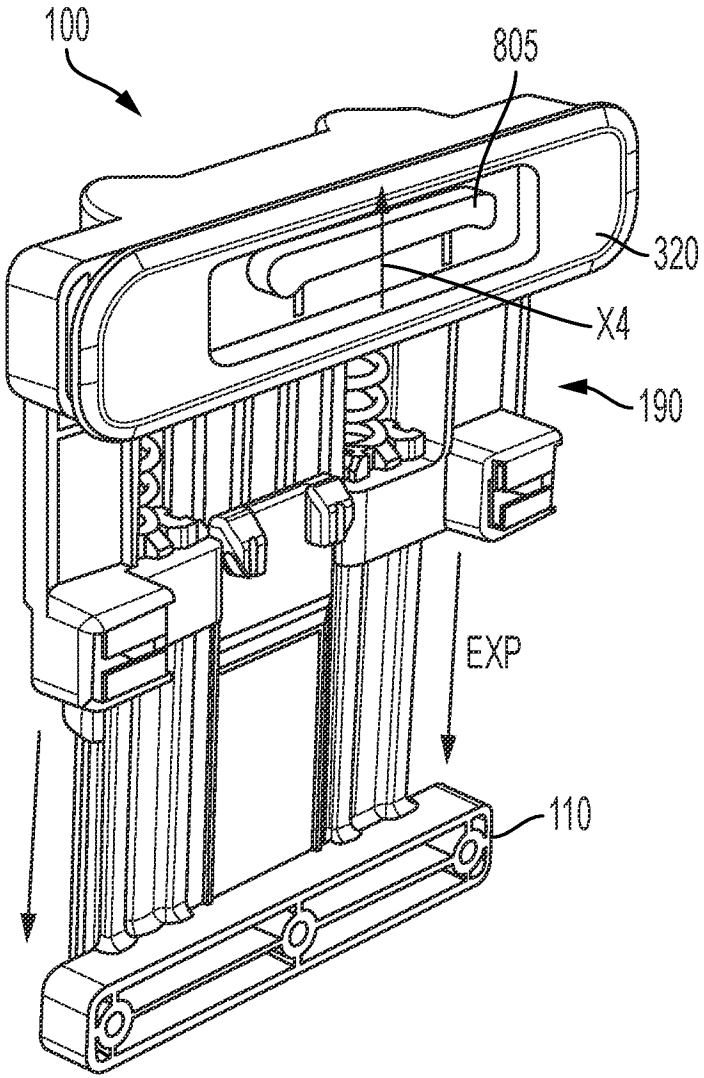
Figure 16G:
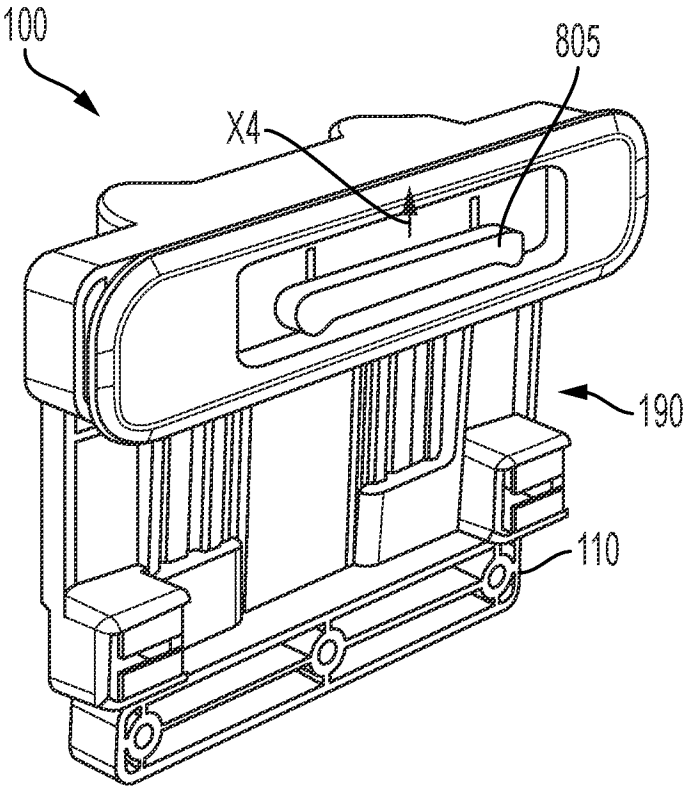
Figure 16J:
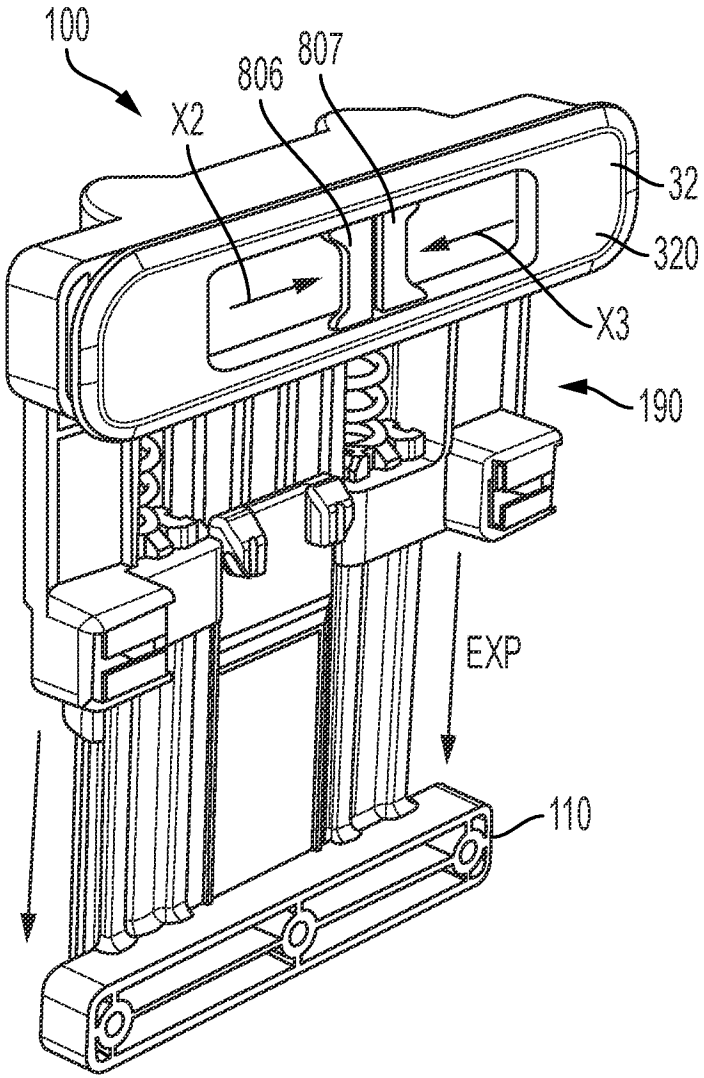
Figure 16I:
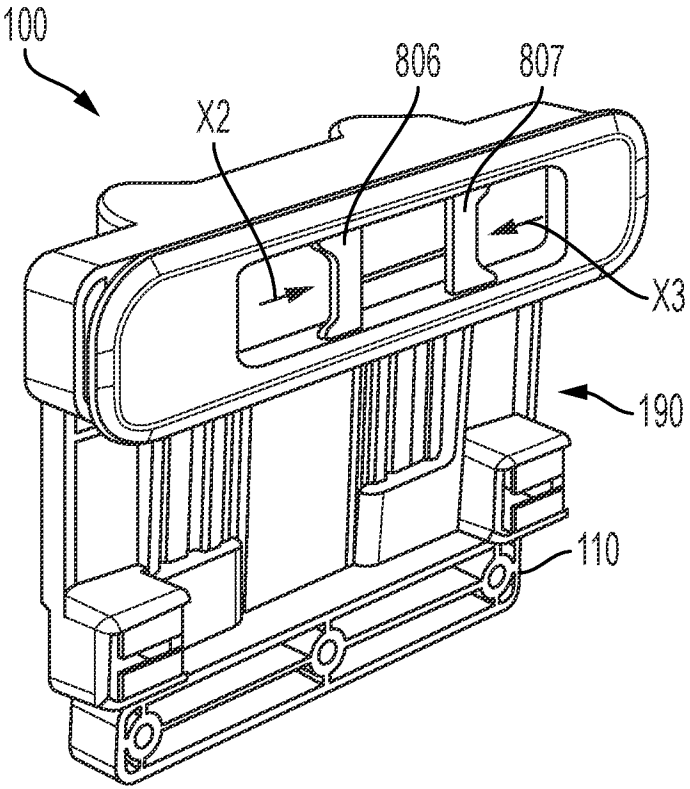
Figure 16L:
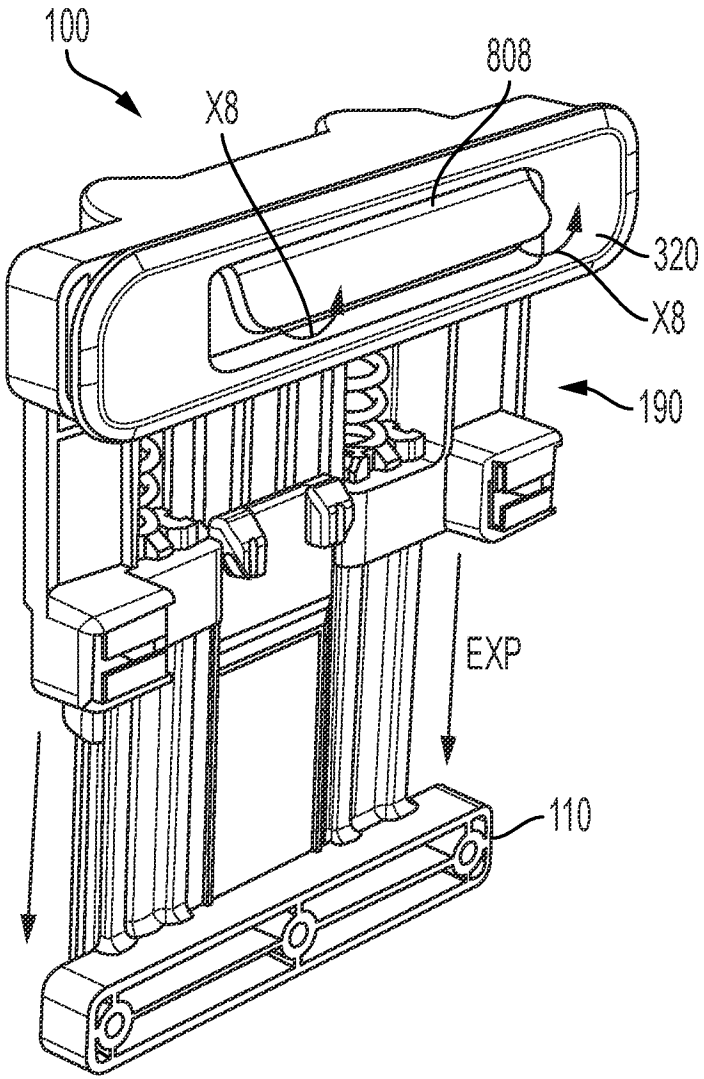
Figure 16K:
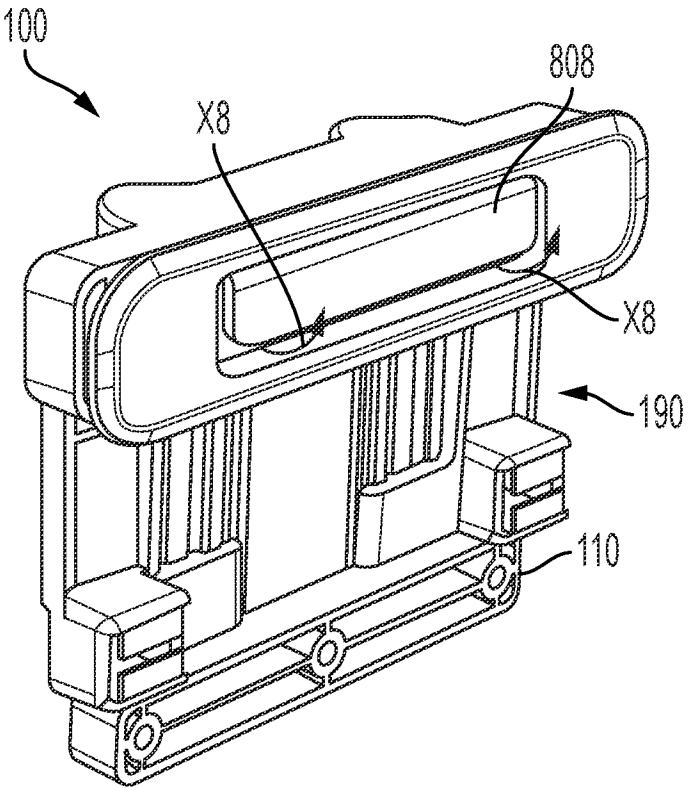
Figure 16N:
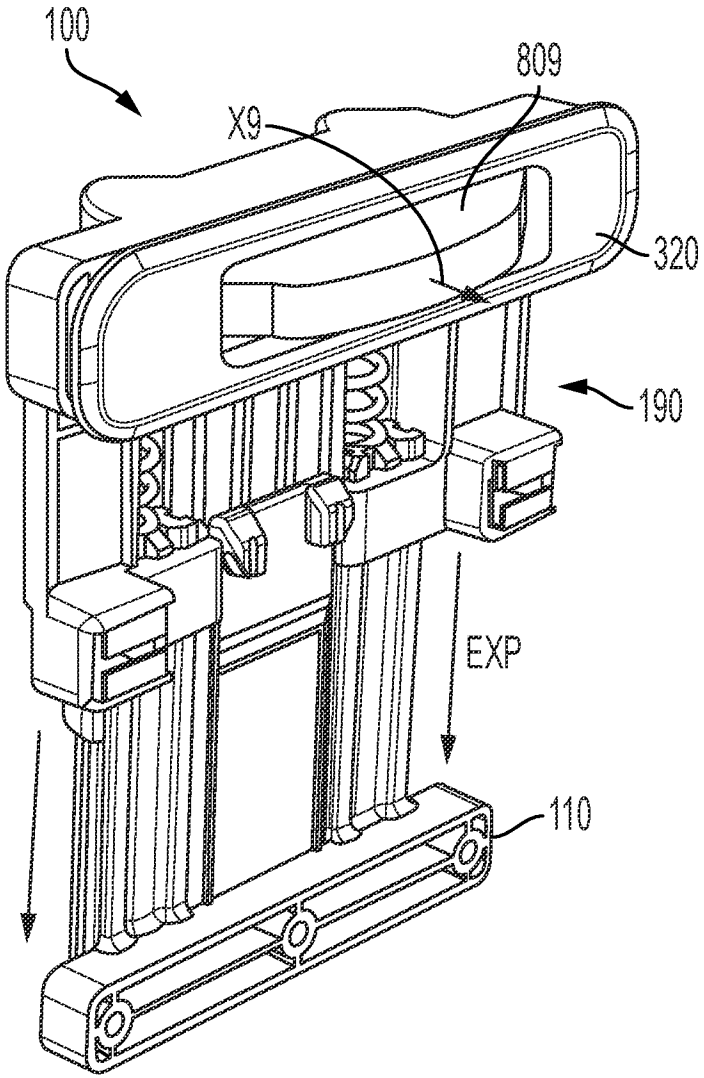
Figure 16M:
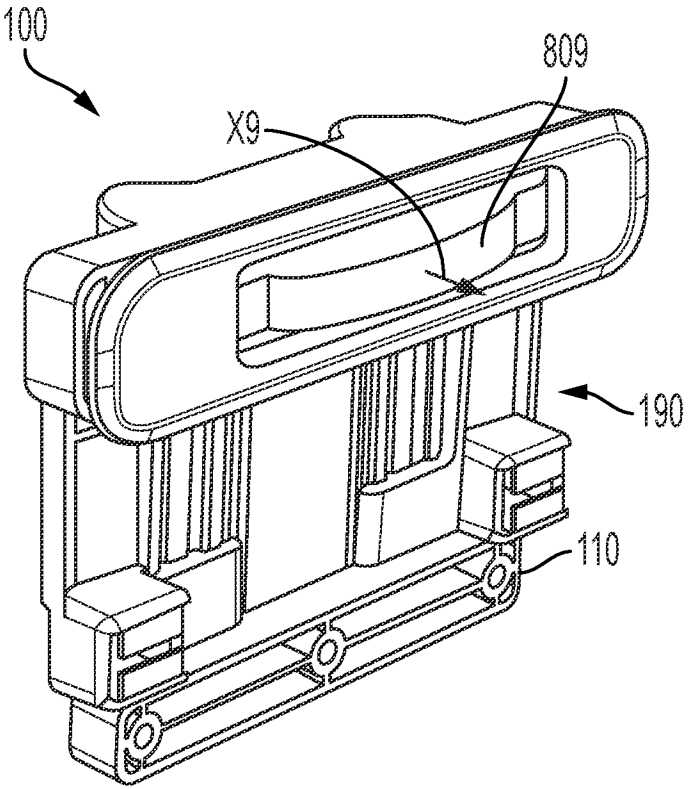

Referring to FIGS. 16A to 16N: at FIGS. 16A and 16B, thereat is an embodiment of an activation member comprising a dial member 800 in the form, e.g., of a knob. When in the compressed configuration for device 100 (FIG. 16A) knob 800 is turned in the direction of arrow X1 which causes base section 110 and expansion body 190 to assume the expanded position shown by arrow EXP in FIG. 16B. FIGS. 16C and 16D depict an embodiment of an activation member comprising twist member 801 which comprises outwardly extending wings 802, 803 in a compressed configuration (FIG. 16C). Twisting wings 802, 803 are in the direction of arrows X6, X7 causes base section 110 and expansion body 190 to assume the expanded position shown by arrow EXP in FIG. 16D. FIGS. 16E and 16F depict an embodiment of an activation member comprising lever member 804 when device 100 is in a compressed configuration (FIG. 16E). Moving lever 804 in the direction of arrow X5 causes base section 110 and expansion body 190 to assume the expanded position shown by arrow EXP in FIG. 16F. FIGS. 16G and 16H depict an embodiment of an activation member comprising lift member 805 when device 100 is in a compressed configuration (FIG. 16G). Moving lift member 805 in the direction of arrow X4 causes base section 110 and expansion body 190 to assume the expanded position shown by arrow EXP in FIG. 16H. FIGS. 161 and 16J depict an embodiment of an activation member comprising a squeezable member comprised of portions 806 and 807 when device 100 is in a compressed configuration (FIG. 16I). Moving (squeezing) portions 806 and 807 respectively in the directions of arrows X2, X3 causes base section 110 and expansion body 190 to assume the expanded position shown by arrow EXP in FIG. 16J. FIGS. 16K and 16L depict an embodiment of an activation member comprising car-door like member 808 when device 100 is in a compressed configuration (FIG. 16K). Moving car-door like member 808 in the direction of arrow X8, e.g. by pulling 808 upward as in opening a car door handle, causes base section 110 and expansion body 190 to assume the expanded position shown by arrow EXP in FIG. 16L. FIGS. 16M and 16N depict an embodiment of an activation member comprising pull-out member 809, which can comprise a strap or rigid material, when device 100 is in a compressed configuration (FIG. 16M). Moving pull-out member 809 in the direction of arrow X9, e.g. pulling 809 in a direction normal to plate 320, causes base section 110 and expansion body 190 to assume the expanded position shown by arrow EXP in FIG. 16N.

What is claimed is:

1. A compression expansion device for an article of luggage comprising:

a base section and an expansion body, the base section and expansion body disposed in sliding relation to each other and engaged with at least one bias member urging the base section and expansion body away from each other in an expanded configuration, wherein:

(I) the base section comprises a flexible portion, the flexible portion comprising a protuberance facing the expansion body, the expansion body comprising a holding surface complimentary to the protuberance and on which the protuberance rests in a first position wherein the base section and the expansion body are in a compressed configuration; and an activation member opposite from and moveable across the protuberance, the activation member comprising a push projection configured to:

(i) sufficiently contact the flexible portion to urge the protuberance to rest on the holding surface in the first position whereby the base section and expansion body are in the compressed configuration when the activation member is moved to a locked position, and (ii) sufficiently disengage from the flexible portion to displace the protuberance from the holding surface to a second position when the activation member is moved to a release position whereby the base section and expansion body assume the expanded configuration; or (II) the expansion body comprises a flexible portion, the flexible portion comprising a protuberance and a release protrusion both facing the base section, the release protrusion axially spaced from and extending outwardly beyond the protuberance, the base section comprising a holding surface complimentary to the protuberance and on which the protuberance rests in a first position wherein the base section and the expansion body are in a compressed configuration; and an activation member glide switch disposed opposite from and movable across the release projection, the activation member comprising a push projection configured to sufficiently contact the release protrusion to displace the protuberance from the holding surface to a second position when the activation member is moved to a release position whereby the base section and expansion body assume the expanded configuration.

2. The device of claim 1 wherein the activation member comprises a glide switch.

3. The device of claim 1 wherein the activation member comprises any of the following: a dial member, a twist member, a lever member, a lift member, a squeezable member, a handle member, and a pull out member.

4. The device of claim 1 wherein the flexible portion is configured as a leaf spring.

5. The device of claim 4 wherein the at least one bias member is a pair of parallel coil springs and the leaf spring is disposed therebetween.

6. The device of claim 1 wherein the protuberance is configured as a ridge, the holding surface is configured as a ledge or a recess, and the release protrusion comprises at a generally triangular cross section.

7. A compression and expansion device for an article of luggage which comprises:

(a) a base section comprising:

a front face, a rear face, a top end, and a bottom end, a pair of spaced apart, parallel passageways axially disposed on the base section, and a flexible portion interposed between the pair of spaced apart parallel passageways and comprising a protuberance extending outwardly from the rear face;

(b) an expansion body comprising:

an inner face, an outer face, an upper end, and a lower end, a pair of spaced apart parallel conduit members axially disposed on the expansion body, each of the pair of spaced apart parallel conduit members individually mated in a slidable manner with a respective spaced apart parallel passageway of the base section, the inner face of the expansion body disposed opposite the rear face of the base section, and a holding surface interposed between the pair of spaced apart parallel conduit members on the inner face of the expansion body and upon which the protuberance rests in a first position wherein the base section and the expansion body are in a compressed configuration;

(c) a pair of biasing members, each individually disposed within a respective passageway and its respective conduit member, and each individually urging the expansion body away from the base section to an expanded configuration; and (d) a glide switch disposed opposite from and moveable across the protuberance, the glide switch comprising at least one push projection configured to:

(i) sufficiently contact the flexible portion to urge the protuberance to rest on the holding surface in the first position whereby the base section and expansion body are in the compressed configuration when the glide switch is moved to a locked position, and (ii) sufficiently disengage from the flexible portion to displace the protuberance from the holding surface to a second position when the glide switch is moved to a release position whereby the base section and expanded portion assume the expanded configuration.

8. The device of claim 7 wherein the flexible portion is configured as a leaf spring.

9. The device of claim 7 wherein the flexible portion comprises at least one intermediary projection extending outwardly from the front face, each intermediary projection configured to sufficiently contact a respective push projection when the glide switch is moved to the first position, and to sufficiently disengage from the respective push projection when the glide switch is moved to the second position.

10. The device of claim 7 wherein the glide switch is housed in a cover plate attached to the top end of the base section, the cover plate having an opening through which the glide switch is accessed by the user to move the glide switch to the locked position or the release position.

11. The device of claim 10 wherein the glide switch comprises a grip member that extends through the opening and by which the user can move the glide switch to the locked position or the release position.

12. The device of claim 7 wherein the glide switch is moveably configured to slide in a direction transverse to the top end of the base section.

13. The device of claim 7 wherein (i) the pair of spaced apart parallel conduit members axially disposed on the expansion body each individually comprise a slot disposed along all or part of the length of the respective conduit member, each slot having a first closed end proximate the top end of the base section; and (ii) the pair of spaced apart parallel passageways axially disposed on the base section each individually comprise a stop projection configured to extend through a respective slot sufficient to contact the first closed end and stop the movement of the expansion body away from the base section.

14. The device of claim 7 wherein the pair of spaced apart parallel conduit members are each individually of generally cylindrical shape and extend outwardly in part from the rear face of the base section; and the pair of spaced apart parallel conduit members each individually comprise a generally tubular channel and extend outwardly from the outer face of the expansion body.

15. The device of claim 7 wherein each biasing member is individually a coil spring.

16. The device of claim 15 wherein the top end of the base section comprises a pair of stabilizer post projections each individually extending into a respective one of the spaced apart parallel conduit members and configured to fit axially within a respective coil spring.

17. The device of claim 9 wherein at least one intermediary projection comprises a recess or bump complimentary to a respective bump or recess on a respective push projection.

18. A compression and expansion device for an article of luggage which comprises:

(a) a base section comprising:

a front face, a rear face, a top end, and a bottom end, a pair of spaced apart, parallel passageways axially disposed on the base section, and a holding surface disposed between the pair of spaced apart, parallel passageways;

(b) an expansion body comprising:

an inner face, an outer face, an upper end, and a lower end, a pair of spaced apart parallel conduit members axially disposed on the expansion body, each of the pair of spaced apart parallel conduit members individually mated in a slidable manner with a respective spaced apart parallel passageway of the base section, the inner face of the expansion body disposed opposite the rear face of the base section, and a flexible portion disposed between the pair of spaced apart parallel conduit members, the flexible portion comprising a protuberance and a release protrusion both extending outwardly from the inner face of the expansion body, the release protrusion axially spaced from and extending outwardly beyond the protuberance, the protuberance configured to rest against the holding surface in a first position when the base section and the expansion body are in a compressed configuration, the release protrusion axially spaced from and extending outwardly beyond the protuberance, (c) a pair of biasing members, each individually disposed within a respective passageway and its respective conduit member, and each individually urging the expansion body away from the base section to an expanded configuration; and (d) a glide switch disposed opposite from and movable across the release projection, the glide switch comprising a push projection configured to sufficiently contact the release protrusion to displace the protuberance from the holding surface to a second position when the glide switch is moved to a release position whereby the base section and expanded portion assume the expanded configuration.

19. The device of claim 18 wherein the flexible portion is configured as a leaf spring.

20. The device of claim 18 wherein the holding surface comprises a ledge, the protuberance comprises a ridge, and the release projection comprises a generally triangular axial cross section.

21. The device of claim 18 wherein the glide switch is housed in a cover plate attached to the top end of the base section, the cover plate having an opening through which the glide switch is accessed by the user to move the glide switch to the locked position or the release position.

22. The device of claim 21 wherein the glide switch comprises a grip member that extends through the opening and by which the user can move the glide switch to the locked position or the release position.

23. The device of claim 18 wherein the glide switch is moveably configured to slide in a direction transverse to the top end of the base section.

24. The device of claim 18 wherein (i) the pair of spaced apart, parallel passageways axially disposed on the base section each individually comprise a slot disposed along all or part of the length of the respective passageway, each slot having a first closed end proximate the top end of the base section; and (ii) the pair of spaced apart parallel conduit members axially disposed on the expansion body each individually comprise a stop projection configured to extend through a respective slot sufficient to contact the first closed end and stop the movement of the expansion body away from the base section.

25. The device of claim 18 wherein the pair of spaced apart parallel conduit members are each individually of generally cylindrical shape and extend outwardly in part from the rear face of the base section; and the pair of spaced apart parallel conduit members each individually comprise a generally tubular channel and extend outwardly from the outer face of the expansion body.

26. The device of claim 18 wherein each biasing member is individually a coil spring.

27. The device of claim 26 wherein the top end of the base section comprises a pair of stabilizer post projections each individually extending into a respective one of the spaced apart parallel conduit members and configured to fit axially within a respective coil spring.

28. An article of luggage comprising:

a main luggage body having a bottom surface and a cavity formed to receive articles for packing;

an expansion portion having a perimeter defining a cavity;

a foldable gusset joining the luggage main body to the expansion portion; and at least one compression and expansion device disposed on a wall of the article of luggage, the compression and expansion device comprising:

a base section affixed to one of the main luggage body or the expansion portion, and an expansion body affixed to the other of the main luggage body or expansion portion, the base section and expansion body disposed in sliding relation to each other and engaged with at least one bias member urging the base section and expansion body away from each other in an expanded configuration, wherein:

(I) the base section comprises a flexible portion, the flexible portion comprising a protuberance facing the expansion body, the expansion body comprising a holding surface complimentary to the protuberance and on which the protuberance rests in a first position wherein the base section and the expansion body are in a compressed configuration; and a glide switch disposed opposite from and moveable across the protuberance, the glide switch comprising a push projection configured to:

(i) sufficiently contact the flexible portion to urge the protuberance to rest on the holding surface in the first position whereby the base section and expansion body are in the compressed configuration when the glide switch is moved to a locked position, and (ii) sufficiently disengage from the flexible portion to displace the protuberance from the holding surface to a second position when the glide switch is moved to a release position whereby the base section and expanded body assume the expanded configuration; or (II) the expansion body comprises a flexible portion, the flexible portion comprising a protuberance and a release protrusion both facing the base section, the release protrusion axially spaced from and extending outwardly beyond the protuberance, the base section comprising a holding surface complimentary to the protuberance and on which the protuberance rests in a first position wherein the base section and the expansion body are in a compressed configuration; and a glide switch disposed opposite from and movable across the release projection, the glide switch comprising a push projection configured to sufficiently contact the release protrusion to displace the protuberance from the holding surface to a second position when the glide switch is moved to a release position whereby the base section and expansion body assume the expanded configuration.

29. The article of luggage of claim 28 wherein the flexible portion is configured as a leaf spring integral with the base section.

30. The article of luggage of claim 28 wherein the at least one bias member is a pair of parallel coil springs and the leaf spring is disposed therebetween.

31. The article of luggage of claim 28 wherein the protuberance is configured as a ridge, the holding surface is configured as a ledge or a recess, and the release protrusion comprises a generally triangular cross section.

32. The article of luggage of claim 28 wherein a pair of the compression and expansion device each respectively disposed on opposite internal walls of the article of luggage, or on opposite external walls of the article of luggage.

33. The article of luggage of claim 28 wherein the glide switch is accessible externally from an outer wall of the luggage.

34. An article of luggage comprising:

a main luggage body having a bottom surface and a cavity formed to receive articles for packing;

an expansion portion having a perimeter defining a cavity;

a foldable gusset joining the luggage main body to the expansion portion; and at least one compression and expansion device disposed on a wall of the article of luggage, the compression and expansion device comprising:

a) a base section affixed to one of the main luggage body or the expansion portion, the base section comprising:

a front face, a rear face, a top end, and a bottom end, a pair of spaced apart, parallel passageways axially disposed on the base section, and a flexible portion interposed between the pair of spaced apart parallel passageways and comprising a protuberance extending outwardly from the rear face;

(b) an expansion body affixed to the other of the main luggage body or expansion portion, the expansion body comprising:

an inner face, an outer face, an upper end, and a lower end, a pair of spaced apart parallel conduit members axially disposed on the expansion body, each of the pair of spaced apart parallel conduit members individually mated in a slidable manner with a respective spaced apart parallel passageway of the base section, the inner face of the expansion body disposed opposite the rear face of the base section, and a holding surface interposed between the pair of spaced apart parallel conduit members on the inner face of the expansion body and upon which the protuberance rests in a first position wherein the base section and the expansion body are in a compressed configuration;

(c) a pair of biasing members, each individually disposed within a respective passageway and its respective conduit member, and each individually urging the expansion body away from the base section to an expanded configuration; and (d) a glide switch disposed opposite from and moveable across the protuberance, the glide switch comprising at least one push projection configured to:

(i) sufficiently contact the flexible portion to urge the protuberance to rest on the holding surface in the first position whereby the base section and expansion body are in the compressed configuration when the glide switch is moved to a locked position, and (ii) sufficiently disengage from the flexible portion to displace the protuberance from the holding surface to a second position when the glide switch is moved to a release position whereby the base section and expanded portion assume the expanded configuration.

35. The article of luggage of claim 34 wherein the flexible portion is configured as a leaf spring.

36. The article of luggage of claim 34 wherein the flexible portion comprises at least one intermediary projection extending outwardly from the front face, each intermediary projection configured to sufficiently contact a respective push projection when the glide switch is moved to the first position, and to sufficiently disengage from the respective push projection when the glide switch is moved to the second position.

37. The article of luggage of claim 34 wherein the glide switch is housed in a cover plate attached to the top end of the base section, the cover plate having an opening through which the glide switch is accessed by the user to move the glide switch to the locked position or the release position.

38. The article of luggage of claim 37 wherein the glide switch comprises a grip member that extends through the opening and by which the user can move the glide switch to the locked position or the release position.

39. The article of luggage of claim 34 wherein the glide switch is moveably configured to slide in a direction transverse to the top end of the base section.

40. The article of luggage of claim 34 wherein (i) the pair of spaced apart parallel conduit members axially disposed on the expansion body each individually comprise a slot disposed along all or part of the length of the respective conduit member, each slot having a first closed end proximate the top end of the base section; and (ii) the pair of spaced apart parallel passageways axially disposed on the base section each individually comprise a stop projection configured to extend through a respective slot sufficient to contact the first closed end and stop the movement of the expansion body away from the base section.

41. The article of luggage of claim 34 wherein the pair of spaced apart parallel conduit members are each individually of generally cylindrical shape and extend outwardly in part from the rear face of the base section; and the pair of spaced apart parallel conduit members each individually comprise a generally tubular channel and extend outwardly from the outer face of the expansion body.

42. The article of luggage of claim 34 wherein each biasing member is individually a coil spring.

43. The article of luggage of claim 42 wherein the top end of the base section comprises a pair of stabilizer post projections each individually extending into a respective one of the spaced apart parallel conduit members and configured to fit axially within a respective coil spring.

44. The article of luggage of claim 36 wherein at least one intermediary projection comprises a recess or bump complimentary to a respective bump or recess on a respective push projection.

45. The article of luggage of claim 34 wherein the protuberance is configured as a ridge, the holding surface is configured as a ledge or a recess, and the release protrusion comprises a generally triangular cross section.

46. The article of luggage of claim 34 wherein a pair of the compression and expansion device each respectively disposed on opposite internal walls of the article of luggage, or on opposite external walls of the article of luggage.

47. The article of luggage of claim 34 wherein the glide switch is accessible externally from an outer wall of the luggage.

48. An article of luggage comprising:

a main luggage body having a bottom surface and a cavity formed to receive articles for packing;

an expansion portion having a perimeter defining a cavity;

a foldable gusset joining the luggage main body to the expansion portion; and at least one compression and expansion device disposed on a wall of the article of luggage, the compression and expansion device comprising:

a) a base section affixed to one of the main luggage body or the expansion portion, the base section comprising:

a front face, a rear face, a top end, and a bottom end, a pair of spaced apart, parallel passageways axially disposed on the base section, and a holding surface disposed between the pair of spaced apart, parallel passageways;

(b) an expansion body affixed to the other of the main luggage body or expansion portion, the expansion body comprising:

an inner face, an outer face, an upper end, and a lower end, a pair of spaced apart parallel conduit members axially disposed on the expansion body, each of the pair of spaced apart parallel conduit members individually mated in a slidable manner with a respective spaced apart parallel passageway of the base section, the inner face of the expansion body disposed opposite the rear face of the base section, and a flexible portion disposed between the pair of spaced apart parallel conduit members, the flexible portion comprising a protuberance and a release protrusion both extending outwardly from the inner face of the expansion body, the release protrusion axially spaced from and extending outwardly beyond the protuberance, the protuberance configured to rest against the holding surface in a first position when the base section and the expansion body are in a compressed configuration, the release protrusion axially spaced from and extending outwardly beyond the protuberance;

(c) a pair of biasing members, each individually disposed within a respective passageway and its respective conduit member, and each individually urging the expansion body away from the base section to an expanded configuration; and (d) a glide switch disposed opposite from and movable across the release projection, the glide switch comprising a push projection configured to sufficiently contact the release protrusion to displace the protuberance from the holding surface to a second position when the glide switch is moved to a release position whereby the base section and expanded portion assume the expanded configuration.

49. The article of luggage of claim 48 wherein the flexible portion is configured as a leaf spring.

50. The article of luggage of claim 48 wherein the holding surface comprises a ledge, the protuberance comprises a ridge, and the release projection comprises a generally triangular axial cross section.

51. The article of luggage of claim 48 wherein the glide switch is housed in a cover plate attached to the top end of the base section, the cover plate having an opening through which the glide switch is accessed by the user to move the glide switch to the locked position or the release position.

52. The article of luggage of claim 51 wherein the glide switch comprises a grip member that extends through the opening and by which the user can move the glide switch to the locked position or the release position.

53. The article of luggage of claim 48 wherein the glide switch is moveably configured to slide in a direction transverse to the top end of the base section.

54. The article of luggage of claim 48 wherein (i) the pair of spaced apart, parallel passageways axially disposed on the base section each individually comprise a slot disposed along all or part of the length of the respective passageway, each slot having a first closed end proximate the top end of the base section; and (ii) the pair of spaced apart parallel conduit members axially disposed on the expansion body each individually comprise a stop projection configured to extend through a respective slot sufficient to contact the first closed end and stop the movement of the expansion body away from the base section.

55. The article of luggage of claim 48 wherein the pair of spaced apart parallel conduit members are each individually of generally cylindrical shape and extend outwardly in part from the rear face of the base section; and the pair of spaced apart parallel conduit members each individually comprise a generally tubular channel and extend outwardly from the outer face of the expansion body.

56. The article of luggage of claim 48 wherein each biasing member is individually a coil spring.

57. The article of luggage of claim 56 wherein the top end of the base section comprises a pair of stabilizer post projections each individually extending into a respective one of the spaced apart parallel conduit members and configured to fit axially within a respective coil spring.

58. The article of luggage of luggage of claim 48 wherein the protuberance is configured as a ridge, the holding surface is configured as a ledge or a recess, and the release protrusion comprises a generally triangular cross section.

59. The article of luggage of claim 48 wherein a pair of the compression and expansion device each respectively disposed on opposite internal walls of the article of luggage, or on opposite external walls of the article of luggage.

60. The article of luggage of claim 48 wherein the glide switch is accessible externally from an outer wall of the luggage.

* * * * *